US007360315B2

(12) United States Patent
Knepp et al.

(10) Patent No.: US 7,360,315 B2
(45) Date of Patent: Apr. 22, 2008

(54) POURED CONCRETE COLUMN ALIGNMENT AND PLUMBING TOOL

(75) Inventors: Wayne A. Knepp, Morton, IL (US); David E. Laux, East Peoria, IL (US); Kevin Potter, Washington, IL (US)

(73) Assignee: Morton Buildings, Morton, IL (US)

( * ) Notice: Subject to any disclaimer, the term of this patent is extended or adjusted under 35 U.S.C. 154(b) by 72 days.

(21) Appl. No.: 11/531,618

(22) Filed: Sep. 13, 2006

(65) Prior Publication Data

US 2007/0166111 A1 Jul. 19, 2007

Related U.S. Application Data

(60) Provisional application No. 60/759,366, filed on Jan. 17, 2006, provisional application No. 60/759,485, filed on Jan. 17, 2006.

(51) Int. Cl.
*G01B 3/00* (2006.01)

(52) U.S. Cl. ..... 33/370; 33/544; 33/644; 33/613

(58) Field of Classification Search ..... 33/533, 33/544, 1 H, 644–645, 613, 624, 370, 374, 33/375, 395

See application file for complete search history.

(56) References Cited

U.S. PATENT DOCUMENTS

| | | | |
|---|---|---|---|
| 727,583 | A | 5/1903 | Brown |
| 2,332,168 | A | 10/1943 | Riches |
| 3,464,216 | A | 9/1969 | Turzillo |
| 3,540,225 | A | 11/1970 | Muller |
| 3,654,767 | A | 4/1972 | Cavin |
| 3,727,599 | A | 4/1973 | Sugiki et al. |
| 3,757,528 | A | 9/1973 | Finsterwalder et al. |
| 3,962,879 | A | 6/1976 | Turzillo |
| 3,980,268 | A | 9/1976 | Ellis |
| 4,124,015 | A | 11/1978 | Isaksson |

(Continued)

FOREIGN PATENT DOCUMENTS

| | | |
|---|---|---|
| EP | 0302717 | 3/1988 |

(Continued)

*Primary Examiner*—Yaritza Guadalupe-McCall
(74) *Attorney, Agent, or Firm*—Howard & Howard Attorneys, P.C.

(57) ABSTRACT

A tool system is provided for aligning and plumbing a poured concrete form (e.g., a lower vertical form portion) for forming a structural column assembly of the type used for erecting building structures and the like, such as a concrete column or footing formed in situ in an earthen hole. The system includes a center line running vertical to the length of the tool and a two-way level system incorporated therein. The tool can be used to line up the lower vertical form portion with a layout string and plumb the lower vertical form portion square. A metering pole that can be locked in place is used to lower and raise the tool into and out of the lower vertical form portion, wherein the tool is completely rotatable about the metering pole. Once the lower vertical form portion is aligned with the tool, the earthen hole is back filled, thus holding the lower vertical form portion in place in the correct position. A hot knife system can be used in conjunction with the metering pole of the tool to cut the top of the lower vertical form portion to grade.

20 Claims, 31 Drawing Sheets

U.S. PATENT DOCUMENTS

| | | | | |
|---|---|---|---|---|
| 4,144,867 | A | 3/1979 | Wachs et al. | |
| 4,180,047 | A | 12/1979 | Bertelson | |
| 4,197,828 | A | 4/1980 | Schellhorn | |
| 4,233,954 | A | 11/1980 | Visser | |
| 4,242,013 | A | 12/1980 | Watts | |
| 4,318,391 | A | 3/1982 | Wachs et al. | |
| 4,327,703 | A | 5/1982 | Destree | |
| 4,368,720 | A | 1/1983 | Destree | |
| 4,570,409 | A | 2/1986 | Wilks | |
| 4,627,211 | A | 12/1986 | Foster, Jr. | |
| 4,673,157 | A | 6/1987 | Wells | |
| 4,751,848 | A * | 6/1988 | Miyamoto | 73/654 |
| 4,767,241 | A | 8/1988 | Wells | |
| 5,090,397 | A | 2/1992 | Larsen et al. | |
| 5,139,006 | A | 8/1992 | Trudeau | |
| 5,359,829 | A | 11/1994 | Voita | |
| 5,437,519 | A | 8/1995 | Bullivant | |
| 5,542,785 | A | 8/1996 | Cloud | |
| 5,961,253 | A | 10/1999 | Okawa | |
| 5,984,587 | A | 11/1999 | Odle | |
| 6,062,771 | A | 5/2000 | Roberts | |
| 6,487,781 | B2 | 12/2002 | Johnson | |
| 6,773,208 | B2 | 8/2004 | DeWitt et al. | |
| 2006/0254068 | A1 * | 11/2006 | Shotton et al. | 33/544 |

FOREIGN PATENT DOCUMENTS

| | | |
|---|---|---|
| JP | 10317374 | 2/1998 |
| WO | WO2004081294 | 9/2004 |
| WO | WO2006001589 | 1/2006 |

* cited by examiner

POURED CONCRETE COLUMN ALIGNMENT AND PLUMBING TOOL

CROSS-REFERENCE TO RELATED APPLICATION

The instant application claims priority to U.S. Provisional Application Ser. Nos. 60/759,366, filed Jan. 17, 2006, and 60/759,485, filed Jan. 17, 2006, the entire specifications of both of which are expressly incorporated herein by reference.

FIELD OF THE INVENTION

The present invention relates generally to alignment and plumbing tools for use in the construction of buildings, structures and/or the like, and more particularly relates to a poured concrete column alignment and plumbing tool for use in conjunction with form systems for use with a poured concrete column hole for in situ formation of a concrete column or footing.

BACKGROUND OF THE INVENTION

Structural column assemblies of the type used for post-frame construction and pole frame structures typically include an elongated wooden post having a bottom end anchored in the earth and a top, free standing end fixed in an upright position upon which framing, trusses or other structural elements are then attached. The bottom end of the post is typically supported in the earthen hole by either back-filled dirt or gravel or perhaps by concrete formed in situ thereabout.

In many applications, building codes require a concrete footing of perhaps 8 inches or 12 inches, for example, to be formed under the bottom of the column post. Examples of such concrete footings are poured concrete footings, wherein a form, such as circular forms, is typically placed in the earthen hole at a precise location, at a precise orientation (e.g., level and plumb), and at precise depth. The positioning of the concrete form was generally time-consuming, laborious and haphazard and was typically accomplished with a combination of alignment strings, levels (e.g., torpedo levels), and/or visual inspection (e.g., "eyeballing"). Once the positioning of the form was set, the concrete mixture would then be poured into the form, wherein it was then allowed to sufficiently cure or harden, thus providing the requisite support and/or load distribution to the structure to be built thereon. However, problems occurred when the precision of the location, orientation and/or depth of the form was not within acceptable limits, which lead to poorly aligned and/or positioned concrete footings which adversely affected the structural integrity of the structure built thereupon.

Accordingly, there is a need for new and improved form systems for producing poured concrete columns or footings in excavated holes that overcome at least one of the disadvantages and shortcomings existing in the prior art.

SUMMARY OF THE INVENTION

In accordance with the general teachings of the present invention, a form system is provided for forming a structural column assembly of the type used for erecting building structures and the like, such as a concrete footing formed in situ in an earthen hole. Also provided are methods for making and using the form systems of the present invention.

The form system includes a support system, including a wire support member and an associated base foam ring having an offset center hole corresponding to the centerline of the concrete footing, which is placed at the bottom of the earthen hole. A lower vertical form system, including multiple interlocking pieces, is assembled and joined at one end to an offset disk member. The disk member of the lower vertical form system is then placed onto the base foam ring in abutting engagement. The form system is then plumbed and positioned, e.g., in relation to one or more layout strings. Once the form system is in the correct position, the earthen hole is backfilled, e.g., with earth or other material, thus holding the properly positioned form system in place. The lower vertical form system is then cut to grade. Reinforcing assemblies, such as rebar, can then be inserted into the lower vertical form system. Concrete can then be poured into the lower vertical form system, thus forming a lower portion of the concrete footing. An upper vertical form system can then be used to form the upper portion of the concrete footing, e.g., that portion that is above grade.

In accordance with a first embodiment of the present invention, a system is provided for aligning, leveling or plumbing a vertical form system for forming a structural element in situ in an earthen hole, comprising: (1) a metering pole assembly, comprising: (a) a metering pole member; and (b) a selectively operable fastening system located at a first end of the metering pole member; and (2) an alignment assembly, comprising: (a) a first face member having an area defining a first aperture formed therein; and (b) a second face member having an area defining a second aperture formed therein, wherein the first and second face members are held in fixed relationship with respect to one another such that the first and second apertures are substantially axially aligned, wherein either the first or second face members includes a level system operably associated therewith, wherein the level system is operable to determine a characteristic of the vertical form system selected from the group consisting of level, plumb, and combinations thereof, wherein the first and second apertures are operable to receive a second end of the metering pole member such that the alignment assembly is disposed about and releaseably mated to the metering pole assembly, wherein the alignment assembly is selectively operable to rotate about the metering pole member and travel along a length of the metering pole member, wherein the mated metering pole member and alignment assembly are selectively operable to be received within an annular inner face formed in the vertical form system, wherein the fastening system is selectively operable to deploy a fastening member into the inner face of the vertical form system so as to maintain the metering pole member and the alignment assembly in fixed relationship with the vertical form system.

In accordance with one aspect of this embodiment, a first disk member is disposed about the metering pole member and a second disk member is disposed about the metering pole member, wherein the first and second disk members are spaced apart, wherein the second disk member is located proximate to the first end of the metering pole member, wherein the fastening system is adjacent to the second disk member, wherein either the first or second disks abut against the inner face of the vertical form system. By way of a non-limiting example, the alignment assembly rests upon the first disk member.

In accordance with another aspect of this embodiment, a side face member is disposed between the first and second face members, wherein either the first or side face members include a centering line disposed on a surface thereof.

In accordance with still another aspect of this embodiment, a rotatable handle member is operably associated with the metering pole member and the fastening system, wherein the rotatable handle member is selectively operable to deploy the fastening member when the handle member is rotated in a first direction and selectively operable to retract the fastening member when the handle member is rotated in a second direction.

In accordance with still yet another aspect of this embodiment, a transit system is releasably disposed on the first face member, wherein the transit system is selectively operable to determine a grade level for the vertical form system.

In accordance with a further aspect of this embodiment, a cutting system is rotatably disposed about the metering pole member and resting on the first face member, wherein the cutting system is selectively operable to cut an annular top portion of the vertical form system to a grade level. By way of a non-limiting example, the vertical form system is either aligned, leveled or plumbed when the alignment assembly is fixed relative to a first height of the vertical form system and the annular top portion of the vertical form system is cut when the alignment assembly is fixed relative to a second height of the vertical form system.

In accordance with a first alternative embodiment of the present invention, a system is provided for aligning, leveling or plumbing a vertical form system for forming a structural element in situ in an earthen hole, comprising: (1) a metering pole assembly, comprising: (a) a metering pole member; (b) a first disk member disposed about the metering pole member; (c) a second disk member disposed about the metering pole member, wherein the first and second disk members are spaced apart, wherein the second disk member is located proximate to a first end of the metering pole member; and (d) a selectively operable fastening system adjacent to the second disk member, wherein the fastening system is located at the first end of the metering pole member; and (2) an alignment assembly, comprising: (a) a first face member having an area defining a first aperture formed therein; and (b) a second face member having an area defining a second aperture formed therein, wherein the first and second face members are held in fixed relationship with respect to one another such that the first and second apertures are substantially axially aligned, wherein either the first or second face members includes a level system operably associated therewith, wherein the level system is operable to determine a characteristic of the vertical form system selected from the group consisting of level, plumb, and combinations thereof, wherein the first and second apertures are operable to receive a second end of the metering pole member such that the alignment assembly rests upon the first disk member and is disposed about and releaseably mated to the metering pole assembly, wherein the alignment assembly is selectively operable to rotate about the metering pole member and travel along a length of the metering pole member, wherein the mated metering pole member and alignment assembly are selectively operable to be received within an annular inner face formed in the vertical form system, wherein the fastening system is selectively operable to deploy a fastening member into the inner face of the vertical form system so as to maintain the metering pole member and the alignment assembly in fixed relationship with the vertical form system; and (3) a cutting system rotatably disposed about the metering pole member and resting on the first face member, wherein the cutting system is selectively operable to cut an annular top portion of the vertical form system to grade.

In accordance with one aspect of this embodiment, either the first or second disks abut against the inner face of the vertical form system.

In accordance with another aspect of this embodiment, the alignment assembly rests upon the first disk member.

In accordance with still another aspect of this embodiment, a side face member is disposed between the first and second face members, wherein either the first or side face members include a centering line disposed on a surface thereof.

In accordance with yet another aspect of this embodiment, a rotatable handle member is operably associated with the metering pole member and the fastening system, wherein the rotatable handle member is selectively operable to deploy the fastening member when the handle member is rotated in a first direction and selectively operable to retract the fastening member when the handle member is rotated in a second direction.

In accordance with still yet another aspect of this embodiment, a transit system is releasably disposed on the first face member, wherein the transit system is selectively operable to determine a grade level for the vertical form system.

In accordance with a further aspect of this embodiment, the vertical form system is either aligned, leveled or plumbed when the alignment assembly is fixed relative to a first height of the vertical form system and the annular top portion of the vertical form system is cut when the alignment assembly is fixed relative to a second height of the vertical form system.

In accordance with a second alternative embodiment of the present invention, a method is provided for aligning, leveling or plumbing a vertical form system for forming a structural element in situ in an earthen hole, comprising: (1) providing a metering pole assembly, comprising: (a) a metering pole member; (b) a first disk member disposed about the metering pole member; (c) a second disk member disposed about the metering pole member, wherein the first and second disk members are spaced apart, wherein the second disk member is located proximate to a first end of the metering pole member; and (d) a selectively operable fastening system adjacent to the second disk member, wherein the fastening system is located at the first end of the metering pole member; (2) providing an alignment assembly, comprising: (a) a first face member having an area defining a first aperture formed therein; and (b) a second face member having an area defining a second aperture formed therein, wherein the first and second face members are held in fixed relationship with respect to one another such that the first and second apertures are substantially axially aligned, wherein either the first or second face members includes a level system operably associated therewith, wherein the level system is operable to determine a characteristic of the vertical form system selected from the group consisting of level, plumb, and combinations thereof; (3) disposing the second end of the metering pole member through the first and second apertures such that the alignment assembly rests upon the first disk member and is disposed about and releaseably mated to the metering pole assembly, wherein the alignment assembly is selectively operable to rotate about the metering pole member and travel along a length of the metering pole member; (4) disposing the mated metering pole member and alignment assembly within an annular inner face formed in the vertical form system; (5) deploying a fastening member into the inner face of the vertical form system so as to maintain the metering pole member and the alignment assembly in fixed relationship with the vertical form system; (6) causing the vertical form system to be aligned, leveled or plumbed; and (7) backfilling any space between the earthen hole and an outer face of the vertical form system so as to prevent any subsequent movement of the vertical form system.

In accordance with one aspect of this embodiment, a cutting system is rotatably disposed about the metering pole member and resting on the first face member, wherein the cutting system is selectively operable to cut an annular top portion of the vertical form system to grade.

In accordance with another aspect of this embodiment, the vertical form system is either aligned, leveled or plumbed when the alignment assembly is fixed relative to a first height of the vertical form system and the annular top portion of the vertical form system is cut when the alignment assembly is fixed relative to a second height of the vertical form system.

In accordance with still another aspect of this embodiment, a rotatable handle member is operably associated with the metering pole member and the fastening system, wherein the rotatable handle member is selectively operable to deploy the fastening member when the handle member is rotated in a first direction and selectively operable to retract the fastening member when the handle member is rotated in a second direction.

In accordance with yet another aspect of this embodiment, a transit system is releasably disposed on the first face member, wherein the transit system is selectively operable to determine a grade level for the vertical form system.

Further areas of applicability of the present invention will become apparent from the detailed description provided hereinafter. It should be understood that the detailed description and specific examples, while indicating the preferred embodiment of the invention, are intended for purposed of illustration only and are not intended to limit the scope of the invention.

BRIEF DESCRIPTION OF THE DRAWINGS

The present invention will become more fully understood from the detailed description and the accompanying drawings, wherein.

The same reference numerals refer to the same parts throughout the various Figures.

DETAILED DESCRIPTION OF THE INVENTION

Figure 1:
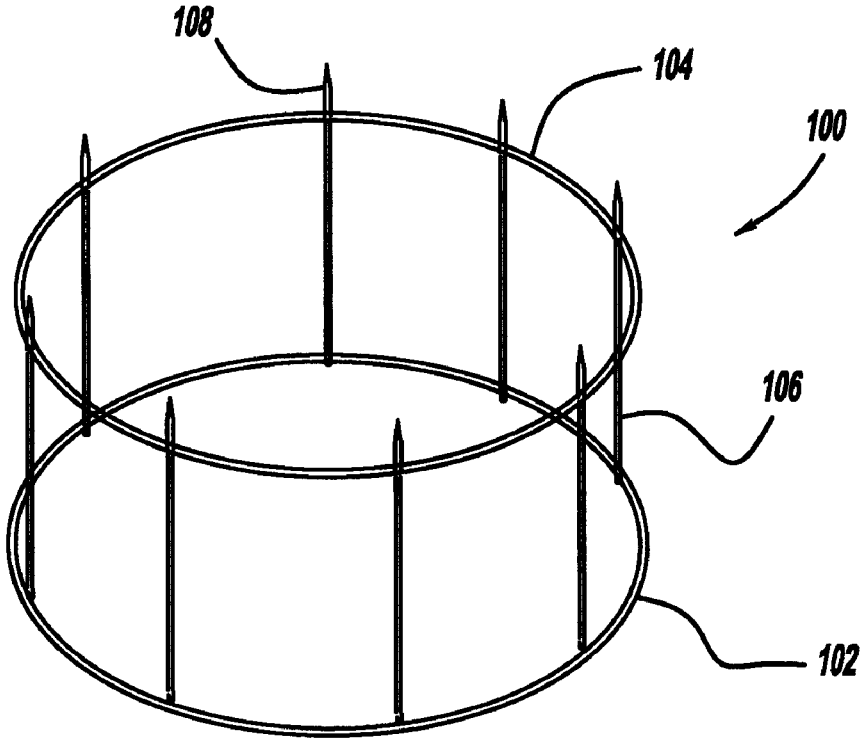
FIG. 1 is a perspective view of a wire support member, in accordance with a first embodiment of the present invention.

The following description of the preferred embodiment(s) is merely exemplary in nature and is in no way intended to limit the invention, or uses.

Referring to the Figures generally, wherein like numerals indicate like or corresponding parts throughout several views, a form system is generally shown at 10 for use with a poured concrete column earthen hole 20 for in situ formation of a concrete column or footing 30. That is, the concrete column or footing 30 is not of the pre-cast type, but rather of that type that is intended to be formed in situ in the earthen hole 20, as will be described herein.

As is known in the art, the earthen hole 20 can be formed or excavated in any number of ways and typically defines a below grade portion 22 and an above grade portion 24. By way of a non-limiting example, the earthen hole 20 can be formed or excavated by any of the known techniques, including but not limited to digging or boring to a depth which is prescribed by local building codes or customs. The depth can be measured longitudinally from the surrounding grade surface 26 to a floor 28 of the earthen hole 20. Typically, the earthen hole 20 will be cylindrical in form, but other shapes are possible. While the concrete column or footing 30 is intended to be formed in the earthen hole 20 in the earth per se, it should be appreciated that foreseeable circumstances may require formation of a hole in some substance other than earth, and that such a hole remains within the meaning of "earthen hole" as that phrase is used here throughout.

By way of a non-limiting example, variable diameter earthen holes 20 are typically formed or excavated at variable depths depending on the loads needed for each particular building or structure column. For example, the precise earthen hole 20 layout pattern can be determined from various sources, including but not limited to the building plan drawings, blueprints, site surveys, and/or the like. A typical earthen hole 20 is shown in cutaway view in FIG. 3.

Figure 2:
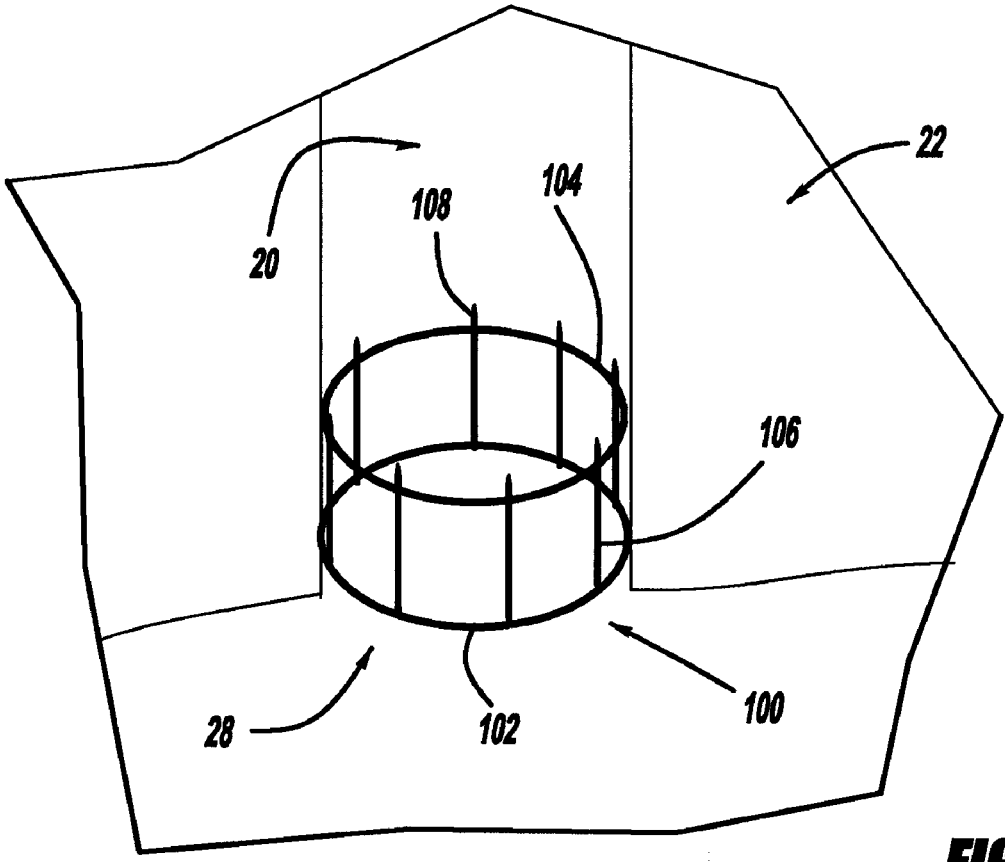
FIG. 2 is a perspective view of the wire support member depicted in FIG. 1, in situ in an earthen hole, in accordance with a second embodiment of the present invention.
Figure 3:
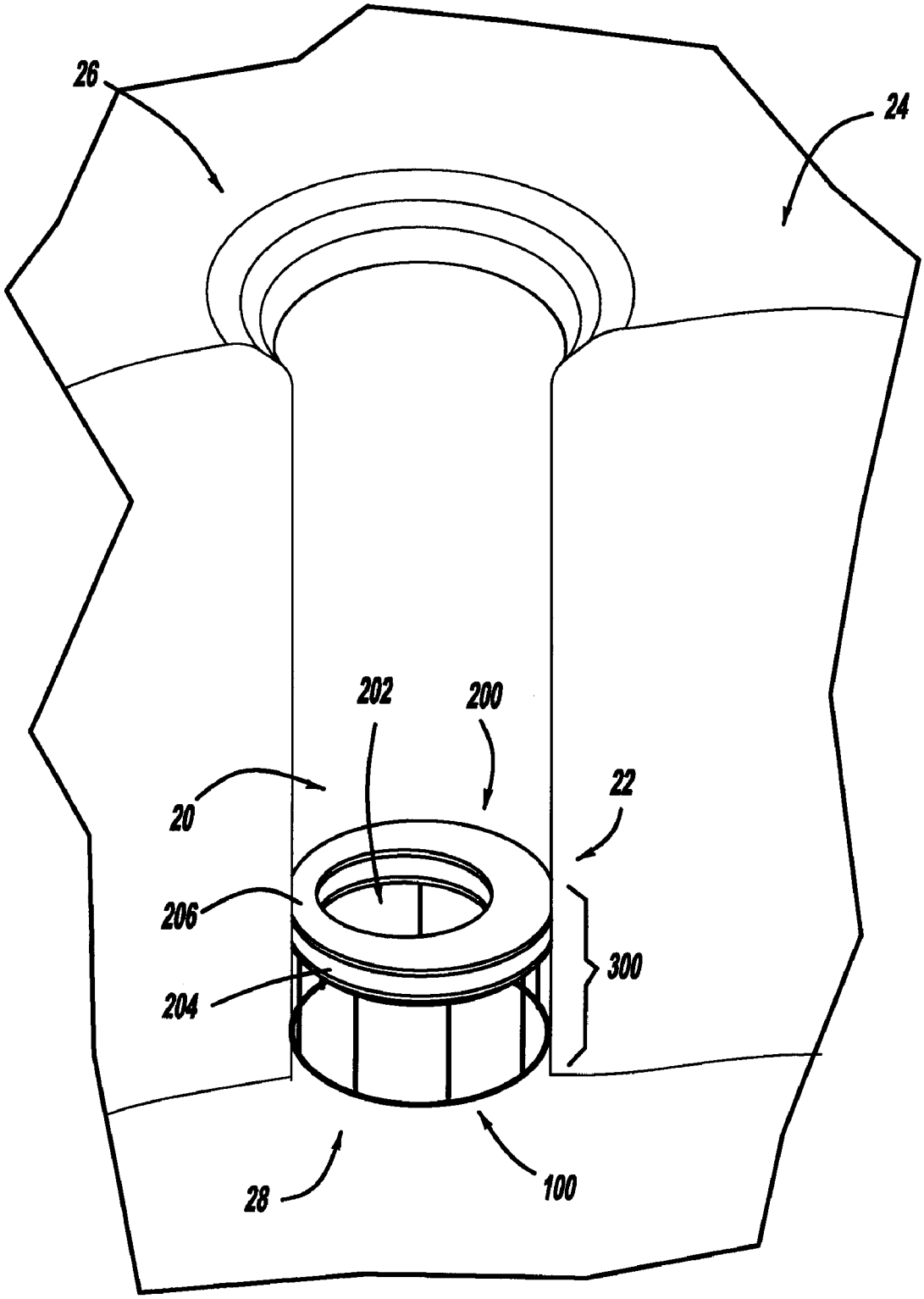
FIG. 3 is a perspective view of a base foam ring disposed on the wire support member depicted in FIG. 1, in situ in an earthen hole, in accordance with a third embodiment of the present invention.
Figure 4:
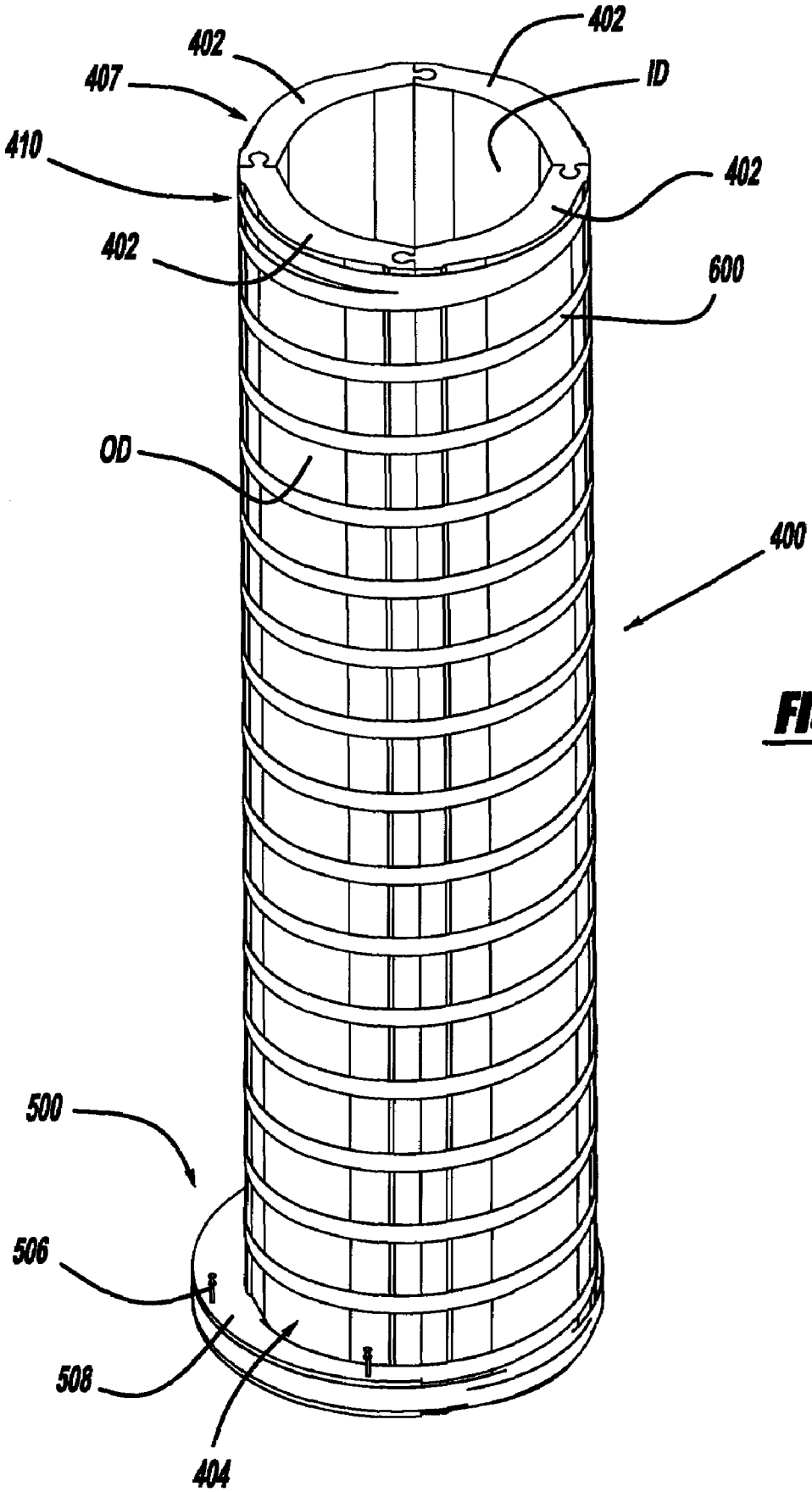
FIG. 4 is a perspective view of a lower vertical form system, in accordance with a fourth embodiment of the present invention.
Figure 5:
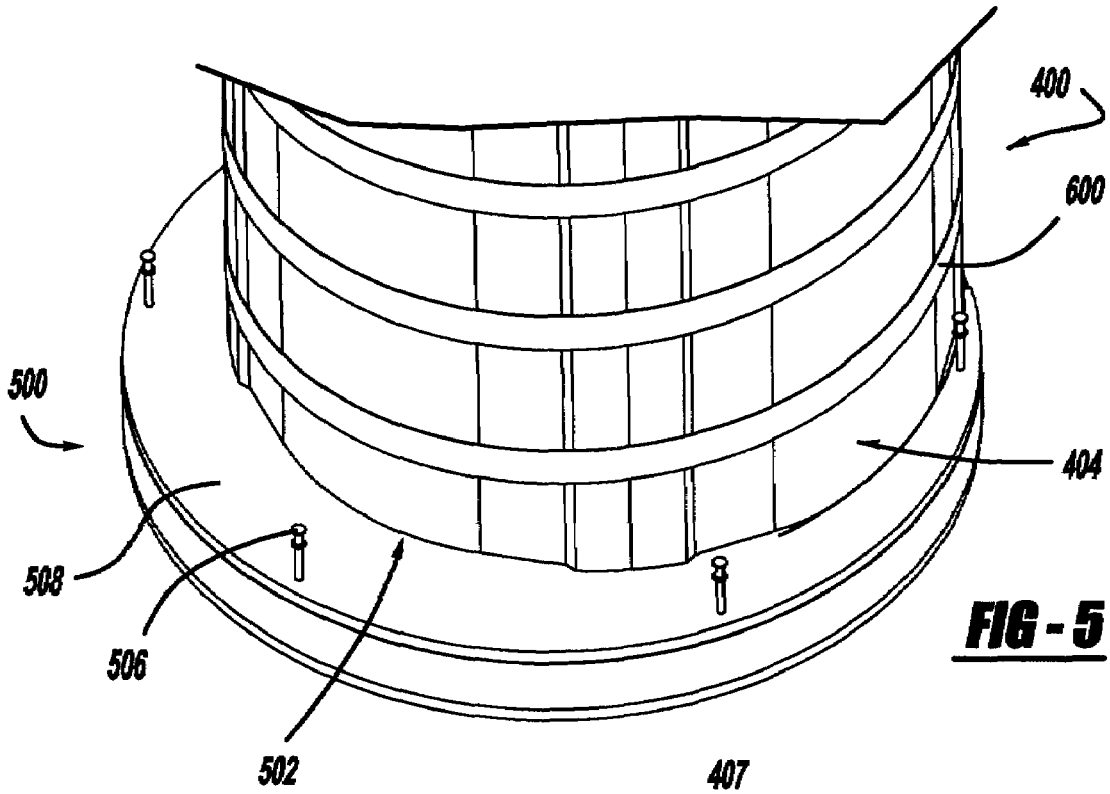
FIG. 5 is a partial perspective view of a bottom portion of the lower vertical form system depicted in FIG. 4, in accordance with a fifth embodiment of the present invention.
Figure 6:
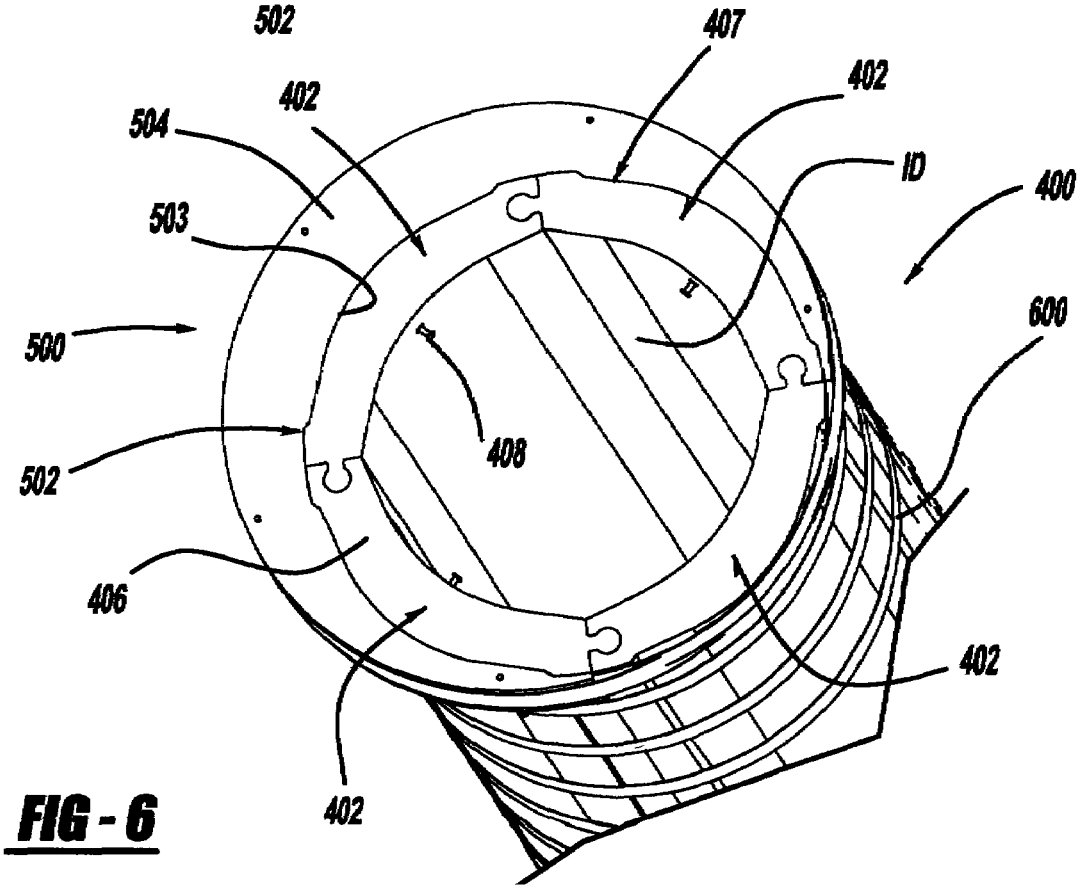
FIG. 6 is a partial bottom view of the bottom portion of the lower vertical form system depicted in FIGS. 4 and 5, in accordance with a sixth embodiment of the present invention.
Figure 7:
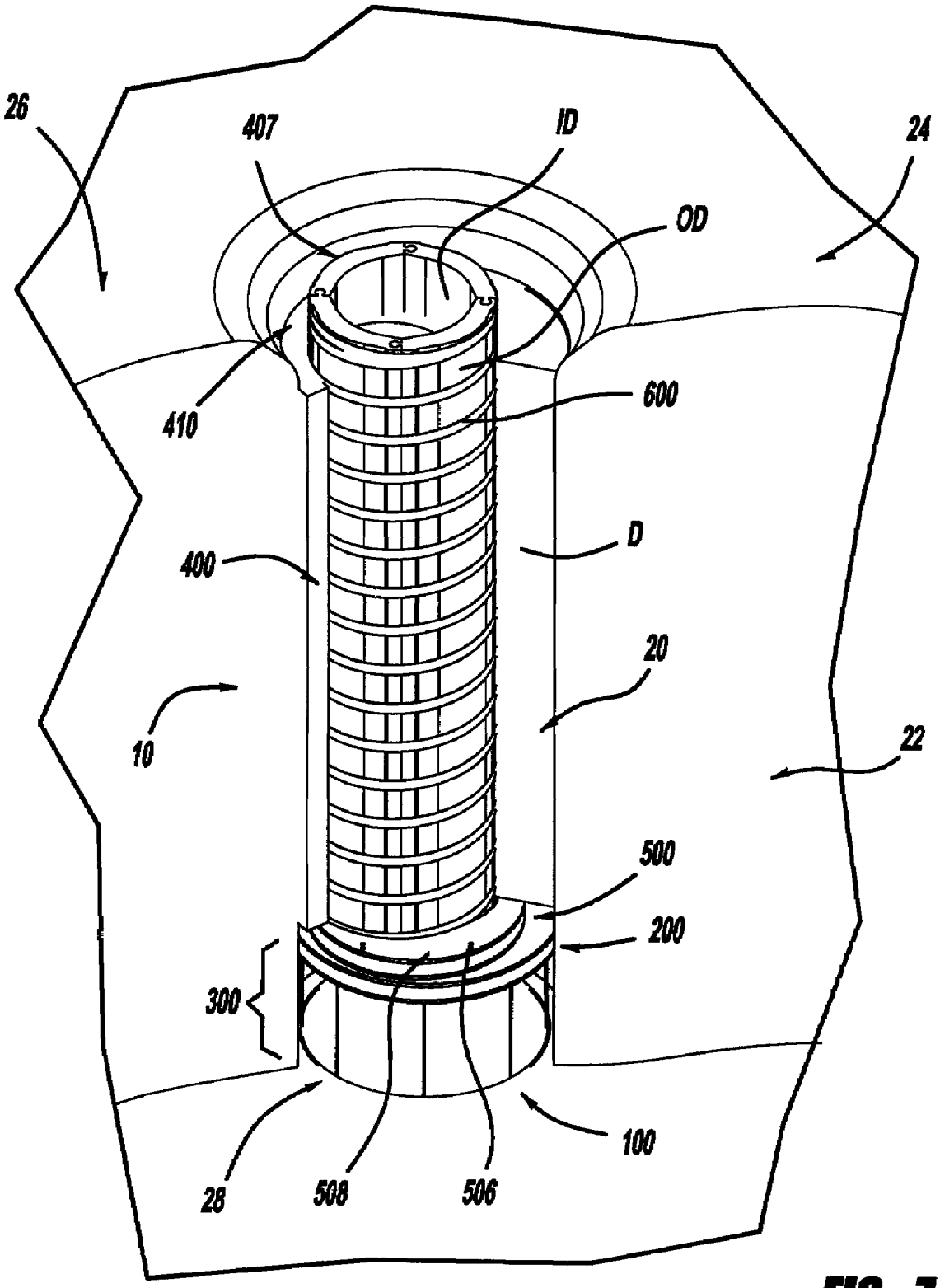
FIG. 7 is a perspective view of the lower vertical form system disposed on the base foam ring, which in turn is disposed on the wire support member, in situ in an earthen hole, in accordance with a seventh embodiment of the present invention.

Referring specifically to FIGS. 1-3, a wire support cage member 100 is intended to be placed into the earthen hole 20, such that it rests substantially levelly on the floor 28 thereof. The wire support cage member 100 can be formed in various configurations such that it defines variable heights, for example, from several inches to several feet, depending on the particular size of the concrete column or footing 30 required for the application. The wire support cage member 100 can be formed of many different materials (e.g., metals, plastics and/or the like); however, because it is intended to function as a support member, the wire support cage member 100 should be able to at least temporarily support the weights/loads of the other components of the form system 10 to be described herein.

The wire support cage member 100 includes a lower ring member 102, an upper ring member 104, and a plurality of spike members 106 fastened (e.g., welded) thereto such that the lower ring member 102 and the upper ring member 104 are substantially fixedly secured in a spaced and opposed configuration with respect to one another. The spike members 106 include pointed end portions 108 that extend above the upper ring member 104, the purpose of which will be explained herein.

As noted, the wire support cage member 100 can be set into the earthen hole 20. However, before placement occurs, a base foam ring member 200 having an area defining an offset center hole 202, a lower face 204, and an upper face 206, can be attached to the wire support cage member 100 to form a support assembly 300. The base foam ring member 200 can be comprised of any number of materials, including foams of course.

By way of a non-limiting example, the lower face 204 of the base foam ring member 200 can be pushed down onto the pointed end portions 108 of the spike member 106 such that the base foam ring member 200 can be held substantially firmly in place relative to the wire support cage member 100. Without being bound to a particular theory of the operation of the present invention, the use of an eccentrically formed base foam ring member 200, e.g., one having an offset center hole 202, as opposed to a centered center hole, is intended to facilitate the positioning and alignment of the other components of the form system 10, to be described herein.

The positioning of the support assembly 300 in the earthen hole 20 can be accomplished in any number of ways. However, the support assembly 300 should be placed in the earthen hole 20 such that the offset center hole 202 can be directly in line with the axial center of the proposed concrete column or footing 30. By way of a non-limiting example, the axial center of the concrete column or footing 30 can be taken from a string line set up to represent the building's or structure's column centerlines.

Referring specifically to FIGS. 4-7, the support assembly 300 is intended to provide adequate support for a lower vertical form system 400.

In accordance with one aspect of the present invention, the lower vertical form system 400 includes a plurality (e.g. four, although less than or more than this number are suitable for use with the present invention) of interlocking (e.g., via a tongue and groove arrangement and/or the like) sections 402 and an offset disk member 500 operably associated with a lower portion 404 of the lower vertical form system 400. By way of a non-limiting example, the offset disk member 500 can be substantially co-planar with a bottom surface 406 of the lower vertical form system 400. The offset disk member 500 can be comprised of any number of materials, such as but not limited to foam, wood, metals, plastics, and/or the like.

The interlocking sections 402 can be comprised of any number of materials (e.g., foam, wood, metal, plastics, and/or the like) and can be formed in variable lengths depending on the particular application required. When the interlocking sections 402 are brought into engagement with one another, the lower vertical form system 400 can be formed. When assembled, the interlocking sections 402 form a cylinder 407 having an outside face or diameter OD and an inside face or diameter ID appropriately sized for the load of the proposed concrete column or footing 30. For added stability, the thus assembled lower vertical form system 400 can be spirally wrapped with an adhesive or filament tape 600 and/or the like.

As previously described, an offset disk member 500 can be fastened to one end, e.g., the lower portion 404, of the lower vertical form system 400. The offset disk member 500 includes an area defining an offset hole 502 (including an inner face 503) that the lower vertical form system 400 fits into, such that the bottom face 504 of the offset disk member 500 can be substantially coplanar with the bottom surface 406 of the lower vertical form system 400. Fasteners 408 (e.g., nails, screws, bolts and/or the like) are then placed (e.g., pushed) through the inner face ID of the lower vertical form system 400 into the offset disk member 500, thus securing the offset disk member 500 to the lower vertical form system 400. Optionally, the filament tape 600 can also be used to secure the offset disk member 500 to the lower vertical form system 400. Additional fasteners 506 (e.g., nails, screws, bolts and/or the like) are then fastened to the upper face 508 of the offset disk member 500, such that the fasteners 506 only extend through the thickness of the offset disk member 500, i.e., they do not extend through the bottom face 504 of the offset disk member 500 at this time.

Once the lower vertical form system 400, with the attached offset disk member 500 is assembled, as described above, it is then placed in the earthen hole 20 on top of the support assembly 300, such that the bottom face 504 of the offset disk member 500 and/or the bottom surface 406 of the lower vertical form system 400 are in abutting relationship with the upper face 206 of the base foam ring member 200. The exact orientation of the bottom face 504 of the offset disk member 500 and/or the bottom surface 406 of the lower vertical form system 400 with the upper face 206 of the base foam ring member 200 is not though to be critical to the success of the present invention, provided that the lower vertical form system 400 is properly supported by the support assembly 300 and that the lower vertical form system 400 can be relatively easily positioned and/or repositioned relative to the support assembly 300. In this manner, the respective offset natures of the offset disk member 500 and the base foam ring member 200 add to the stability of the form system 10, especially when the lower vertical form system 400 is being repositioned in the earthen hole 20.

By way of a non-limiting example, the lower vertical form system 400 can then be slideably rotated on the support assembly 300 so as to align the central vertical axis of the lower vertical form system 400 with the central vertical axis of the offset hole 202 of the base foam ring member 200. The lower vertical form system 400 can then be plumbed and positioned, in any suitable manner, in relation to any layout strings and/or the like.

Figure 8:
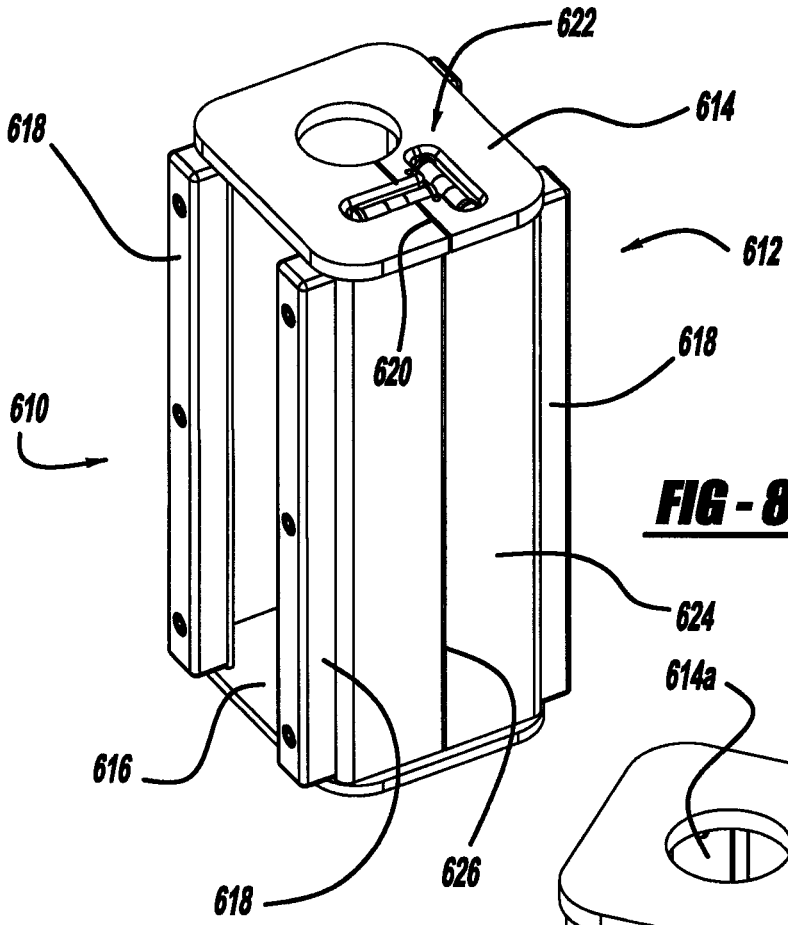
FIG. 8 is a perspective view of an aligning and plumbing tool assembly, in accordance with an eighth embodiment of the present invention.
Figure 9:
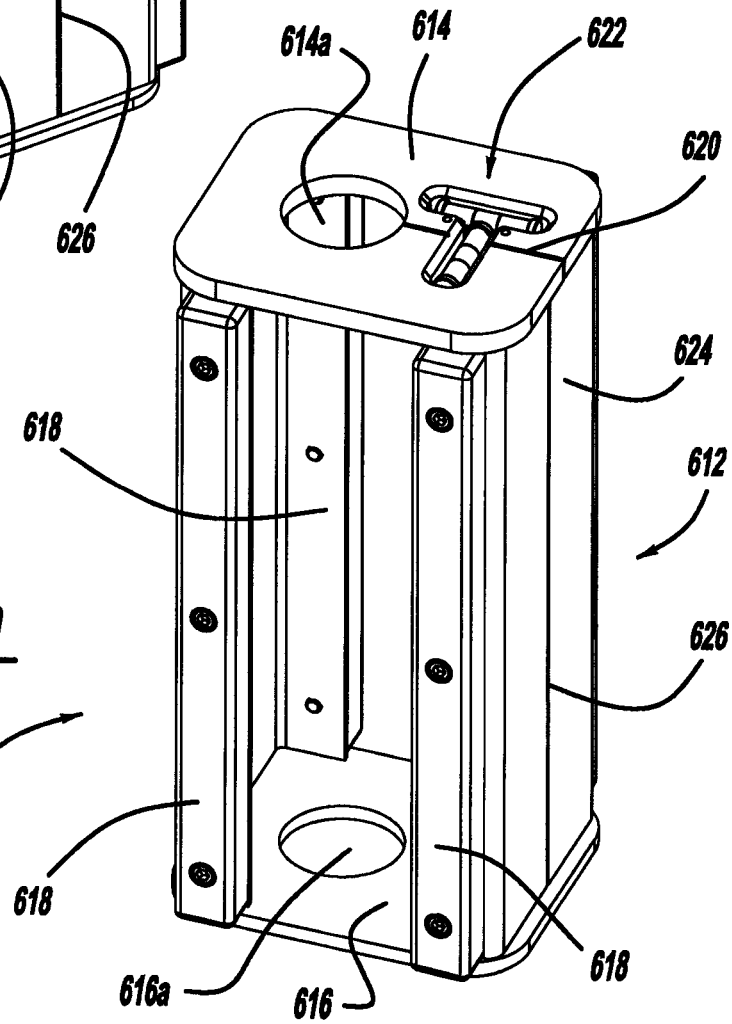
FIG. 9 is another perspective view of the aligning and plumbing tool assembly depicted in FIG. 8, in accordance with a ninth embodiment of the present invention.
Figure 10:
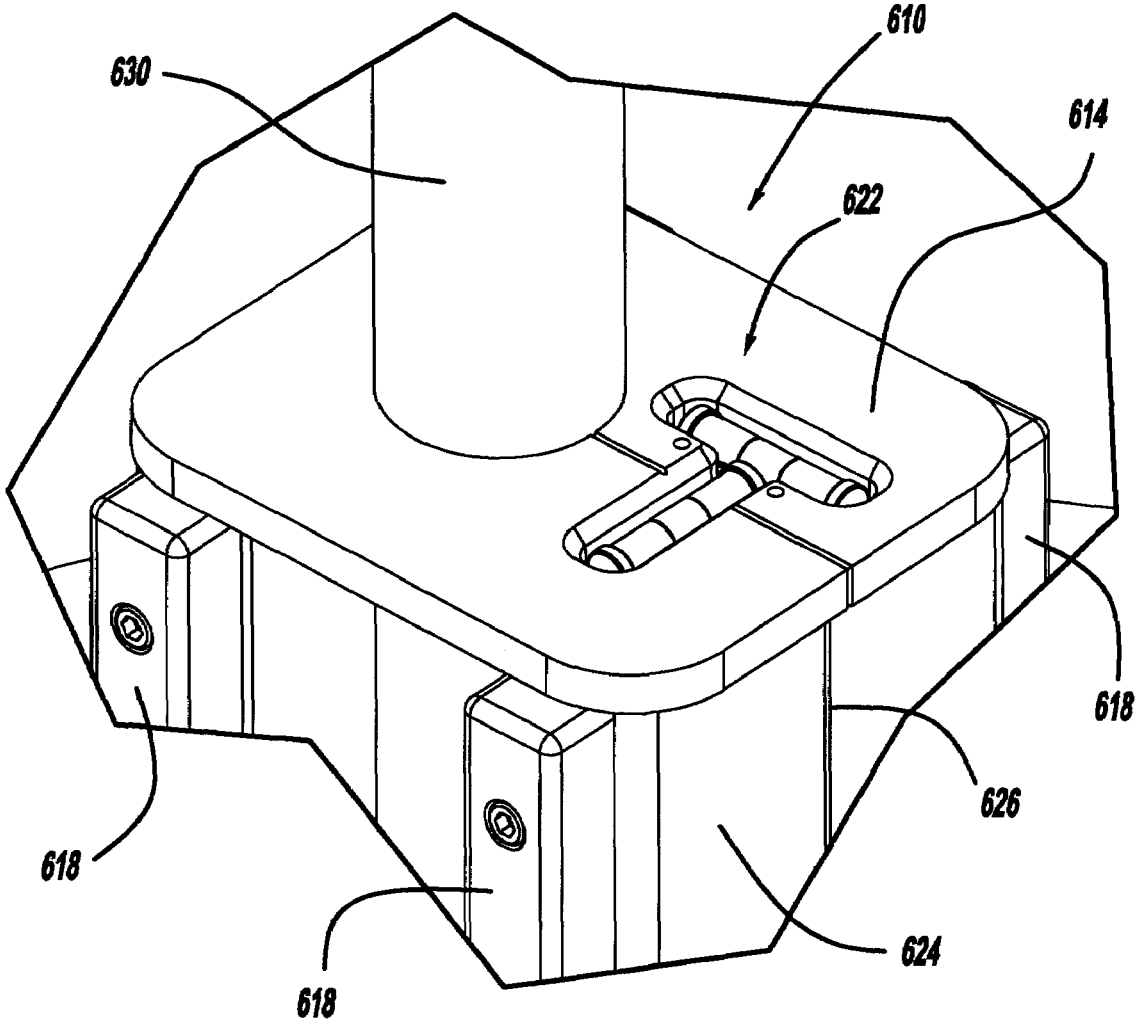
FIG. 10 is a partial detailed view of the aligning and plumbing tool assembly depicted in FIGS. 8 and 9, in accordance with a tenth embodiment of the present invention.

Referring specifically to FIGS. 8-10, an aligning and plumbing tool assembly 610 is provided for accomplishing the aforementioned proper positioning, leveling and/or plumbing of the lower vertical form system 400. The aligning and plumbing tool assembly 610 is intended to be portable in that it can be transported from one location, e.g., an earthen hole, to another location, e.g., another earthen hole, at a construction site such that only one aligning and plumbing tool assembly 610 is required to ensure that all of the concrete columns or footings 30 are properly positioned, leveled and/or plumbed.

Although the alignment and plumbing tool assembly 610 is shown as being comprised of a substantially box-shaped member 612, it should be appreciated that are configurations are equally suitable. In accordance with one aspect of the present invention, the alignment and plumbing tool assembly 610 includes an upper face member 614 and a spaced and opposed lower face member 616, interconnected by a plurality of leg members 618. Both the upper face member 614 and the lower face member 616 are provided with areas defining apertures 614*a*, 616*a*, respectively, formed therein, wherein the apertures 614*a*, 616*a*, respectively, are substantially axially aligned with one another, the purpose of which will be described herein.

In accordance with one aspect of the present invention, the upper face member 614 of the alignment and plumbing tool assembly 610 includes a centering line 620 and a two-way bubble level assembly 622 for reference during the alignment/plumbing process. In accordance with one aspect of the present invention, a side face member 624 of the alignment and plumbing tool assembly 610 includes a centering line 626 for reference during the alignment/plumbing process.

Without being bound to a particular theory of the operation of the present invention, the alignment and plumbing tool assembly 610 is constructed in such a manner so as to represent the intended structural column or footing. By way of a non-limiting example, the alignment and plumbing tool assembly 610 includes the centering line 626 running vertically the length of the alignment and plumbing tool assembly 610 and the two-way bubble level assembly 622 such that the alignment and plumbing tool assembly 610 is operable to line up the lower vertical form system 400 with the existing layout strings and to plumb the lower vertical form system 400 square.

Figure 11:
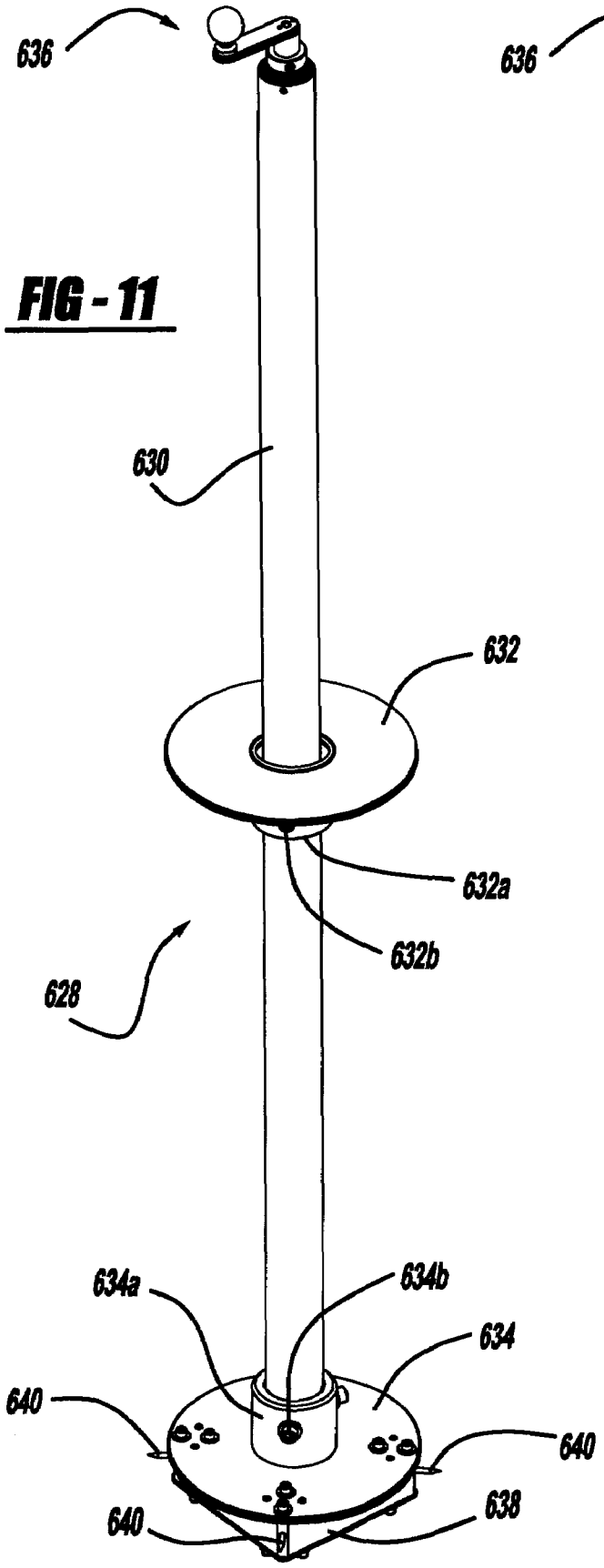
FIG. 11 is a perspective view of a metering pole assembly, in accordance with an eleventh embodiment of the present invention.
Figure 12:
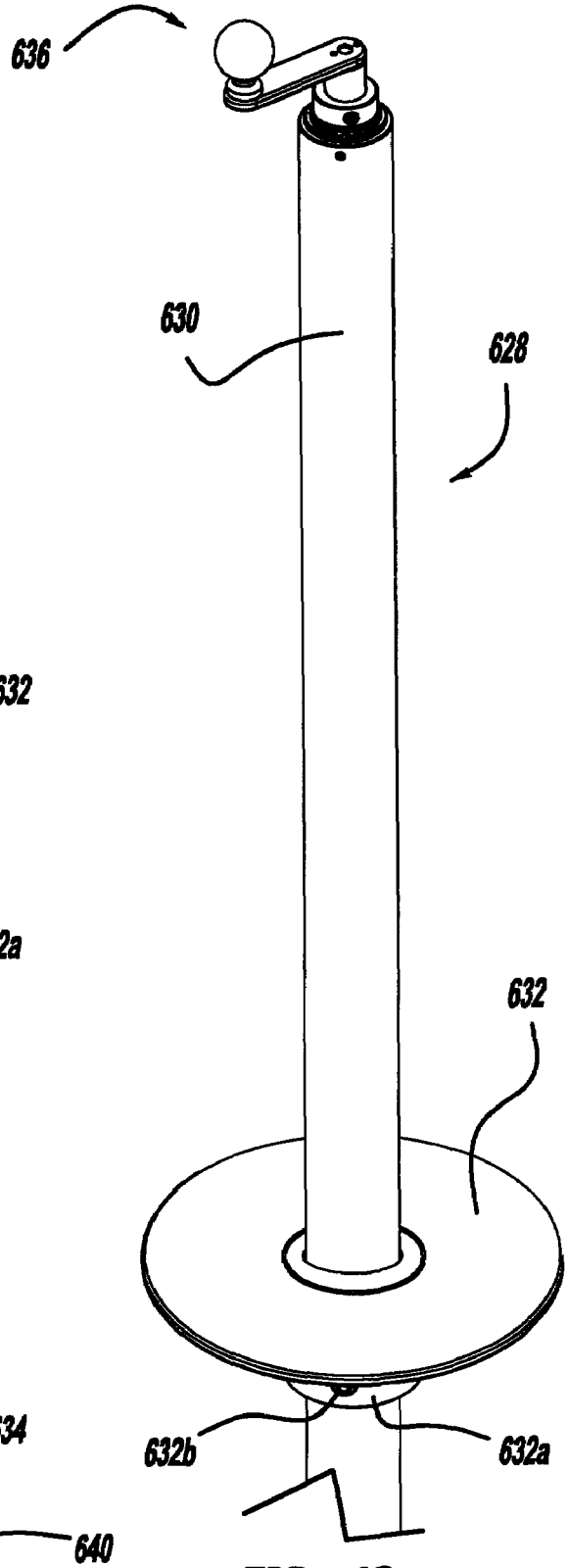
FIG. 12 is a partial detailed view of a top portion of the metering pole assembly depicted in FIG. 11, in accordance with a twelfth embodiment of the present invention.
Figure 13:
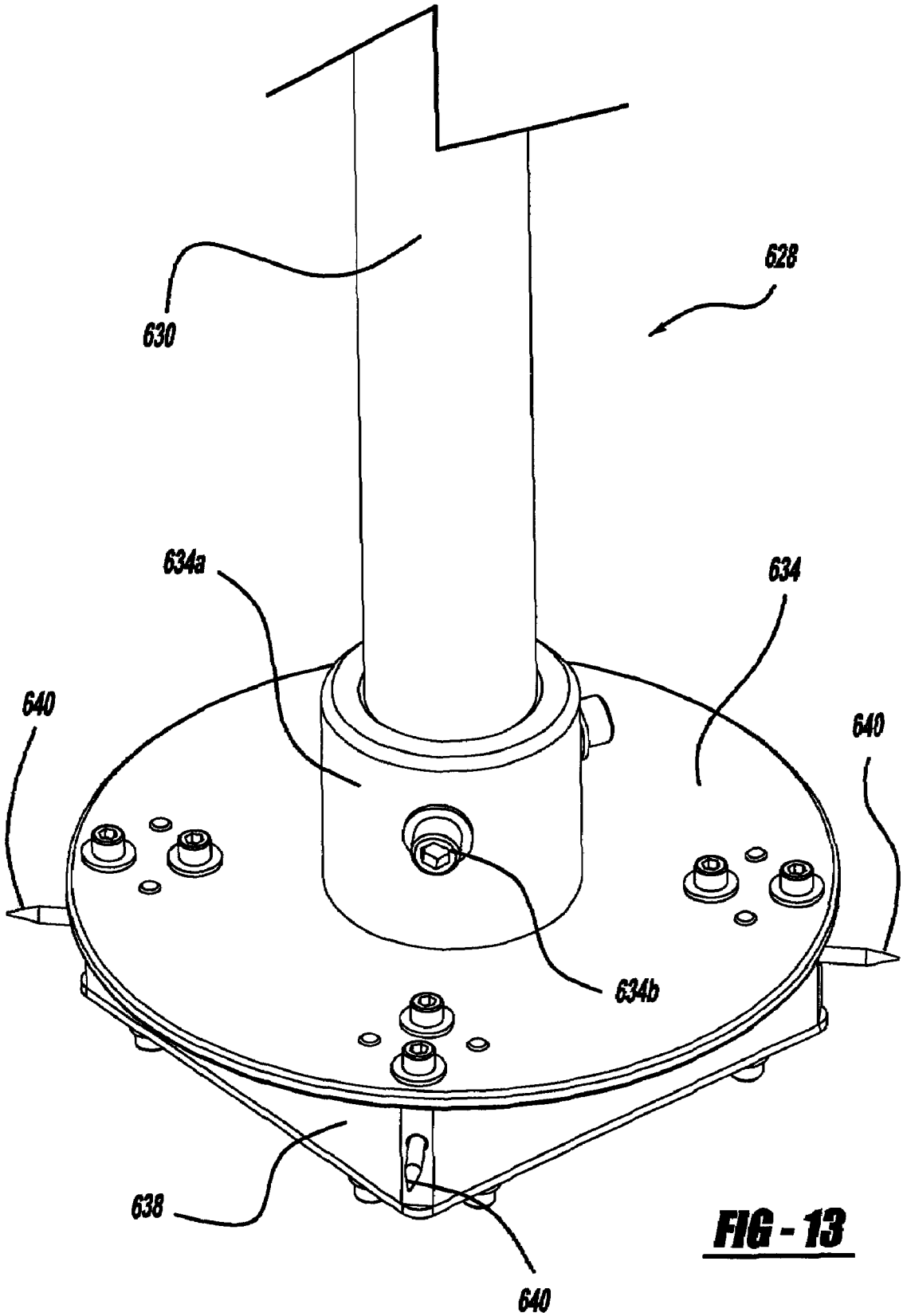
FIG. 13 is a partial detailed view of a bottom portion of the metering pole assembly depicted in FIG. 11, in accordance with a thirteenth embodiment of the present invention.

Referring specifically to FIGS. 11-13, a metering pole assembly 628 is provided for supporting the aligning and plumbing tool assembly 610 during the positioning, leveling and/or plumbing of the lower vertical form system 400.

The metering pole assembly 628 include a pole member 630, an upper disk member 632 radially disposed about a first portion of the pole member 630 (e.g., via bushing or collar 632*a*), a lower disk member 634 radially disposed about a second portion of the pole member 630 (e.g., via bushing or collar 634*a*), and a rotatable handle member 636, the intended purpose of which will be described herein. The upper disk member 632 can be fixed or movable relative to the pole member 630 (e.g., via a fastener 632*b* operably associated with the bushing or collar 632*a*. The lower disk member 634 can also be fixed or movable relative to the pole member 630 (e.g., via a fastener 634*b* operably associated with the bushing or collar 634*a*).

The lower disk member 634 includes a locking box portion 638 operably associated with a bottom portion therein. Housed with the locking box portion 638 are a plurality of spike members 640 with are selectively extendable from and retractable into the platform portion 638 in response to the action of rotatable handle member 636. For example, when the rotatable handle member 636 is rotated in a first direction, the spike members 640 are operable to extend from the locking box portion 638. Conversely, when the rotatable handle member 636 is rotated in a second, i.e., opposite, direction from the first direction, the spike members 640 are operable to retract into the locking box portion 638. In this manner, the metering pole assembly 628 is selectively operable to engage to and/or disengage from the inner face ID of the lower vertical form system 400, as will be described in more detail herein. The mechanism for extending/retracting the spike members 640 can be accomplished through a simple gear assembly, e.g., wherein rotational movement of the rotatable handle member 636 is ultimately translated into substantially linear horizontal movement by the spike members 640.

Figure 14:
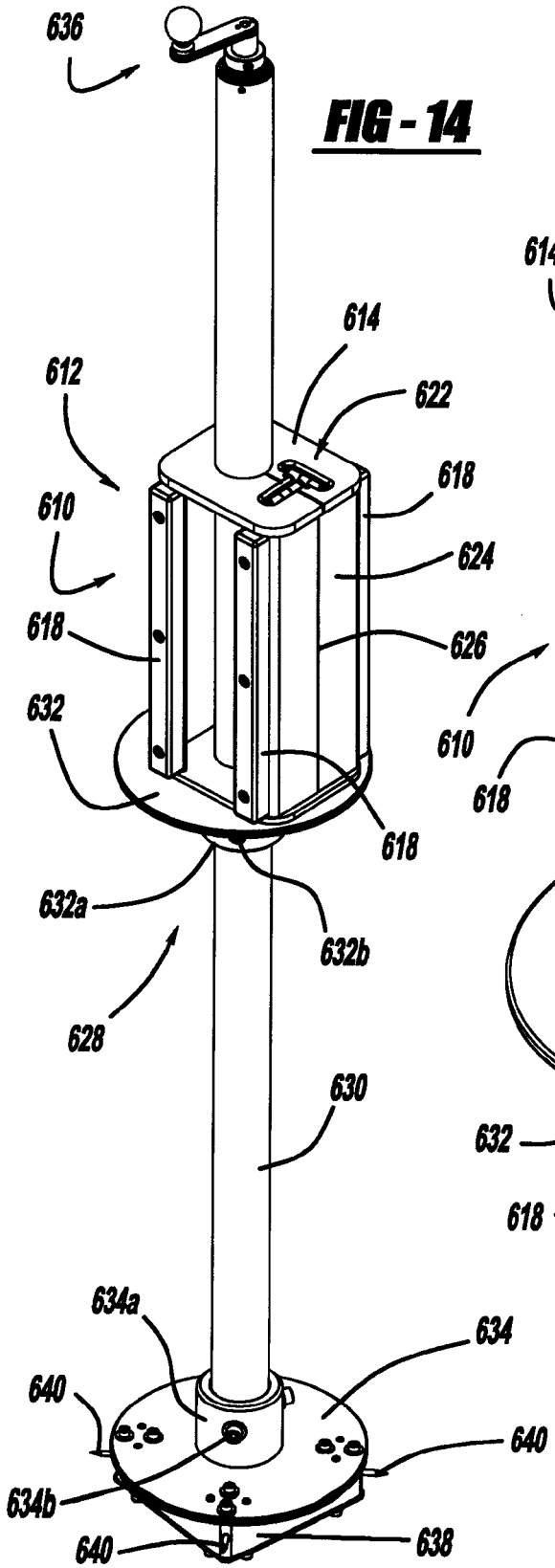
FIG. 14 is a perspective view of the aligning and plumbing tool assembly depicted in FIGS. 8 and 9 mounted on the metering pole assembly depicted in FIG. 11, in accordance with a fourteenth embodiment of the present invention.
Figure 15:
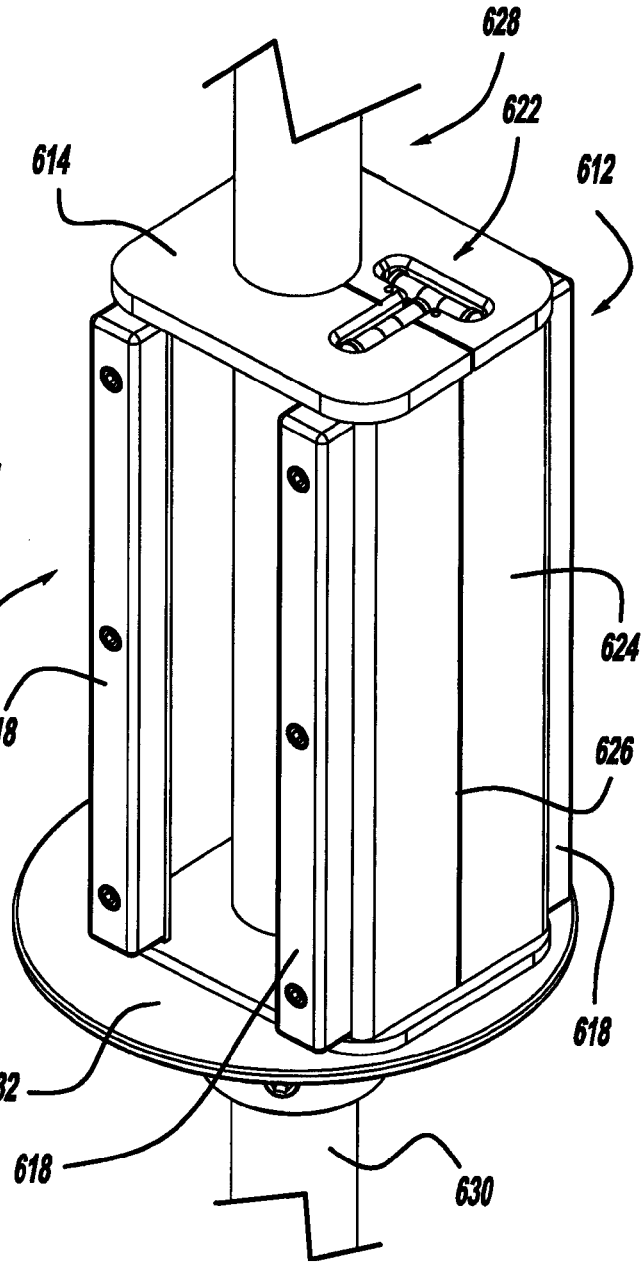
FIG. 15 is a partial detailed view of the aligning and plumbing tool assembly mounted on the metering pole assembly depicted in FIG. 14, in accordance with a fifteenth embodiment of the present invention.

Referring specifically to FIGS. 14-15, the aligning and plumbing tool assembly 610 is shown disposed about the metering pole assembly 628, or more specifically the pole member 630, e.g., via apertures 632*a*, 634*a*, respectively. In this view, the aligning and plumbing tool assembly 610 is shown resting on the upper disk member 632. In order to place the apertures 632*a*, 634*a*, respectively, over the pole member 630, the rotatable handle member 636 can be temporarily removed and then reinstalled after the aligning and plumbing tool assembly 610 has been installed. In this manner, the aligning and plumbing tool assembly 628 is operable to freely rotate 360 degrees around the pole member 620.

Figure 16:
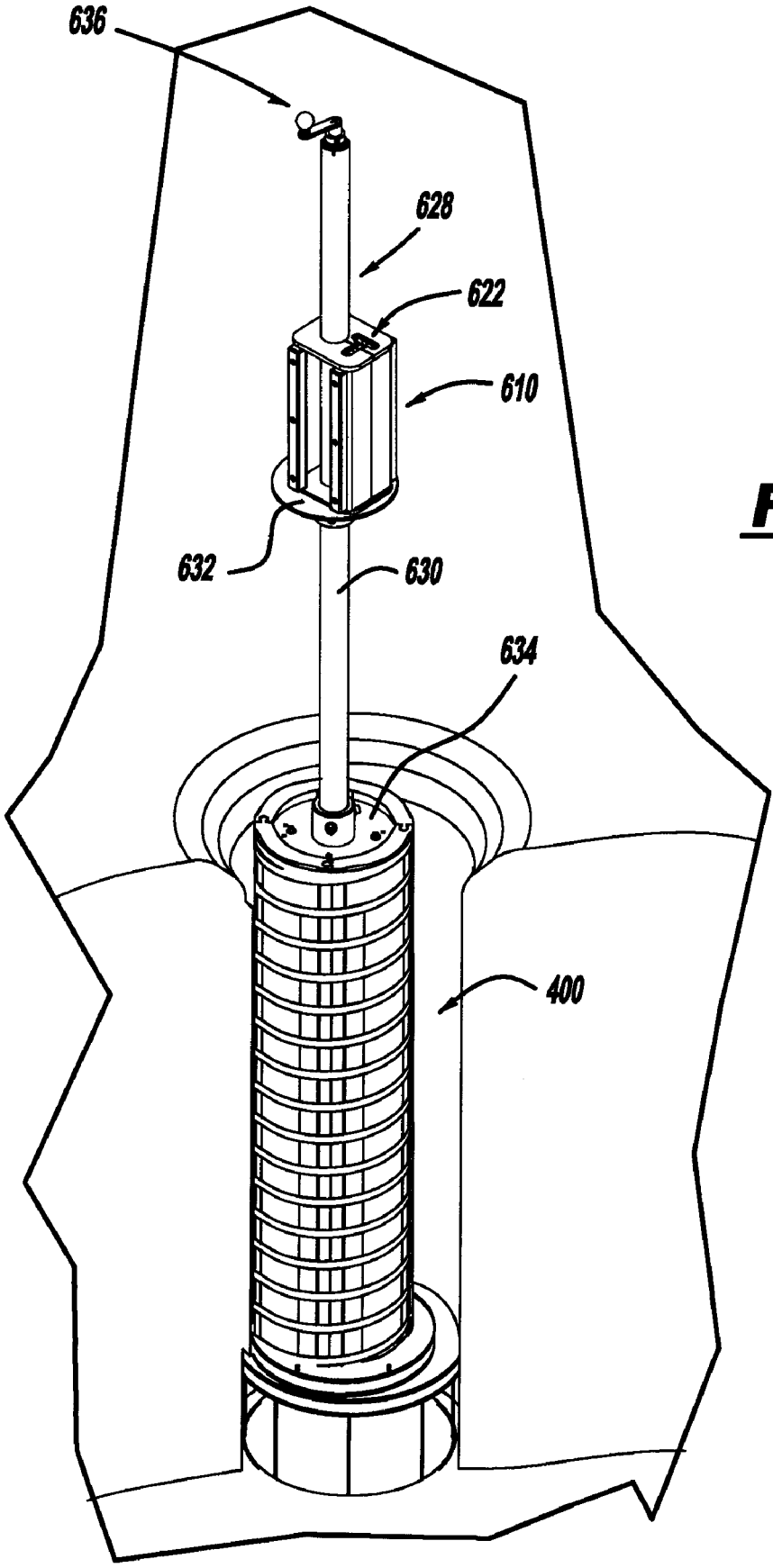
FIG. 16 is a perspective view of the aligning and plumbing tool assembly mounted on the metering pole assembly depicted in FIG. 14 disposed within the lower vertical form system in situ in an earthen hole, in accordance with a sixteenth embodiment of the present invention.
Figure 17:
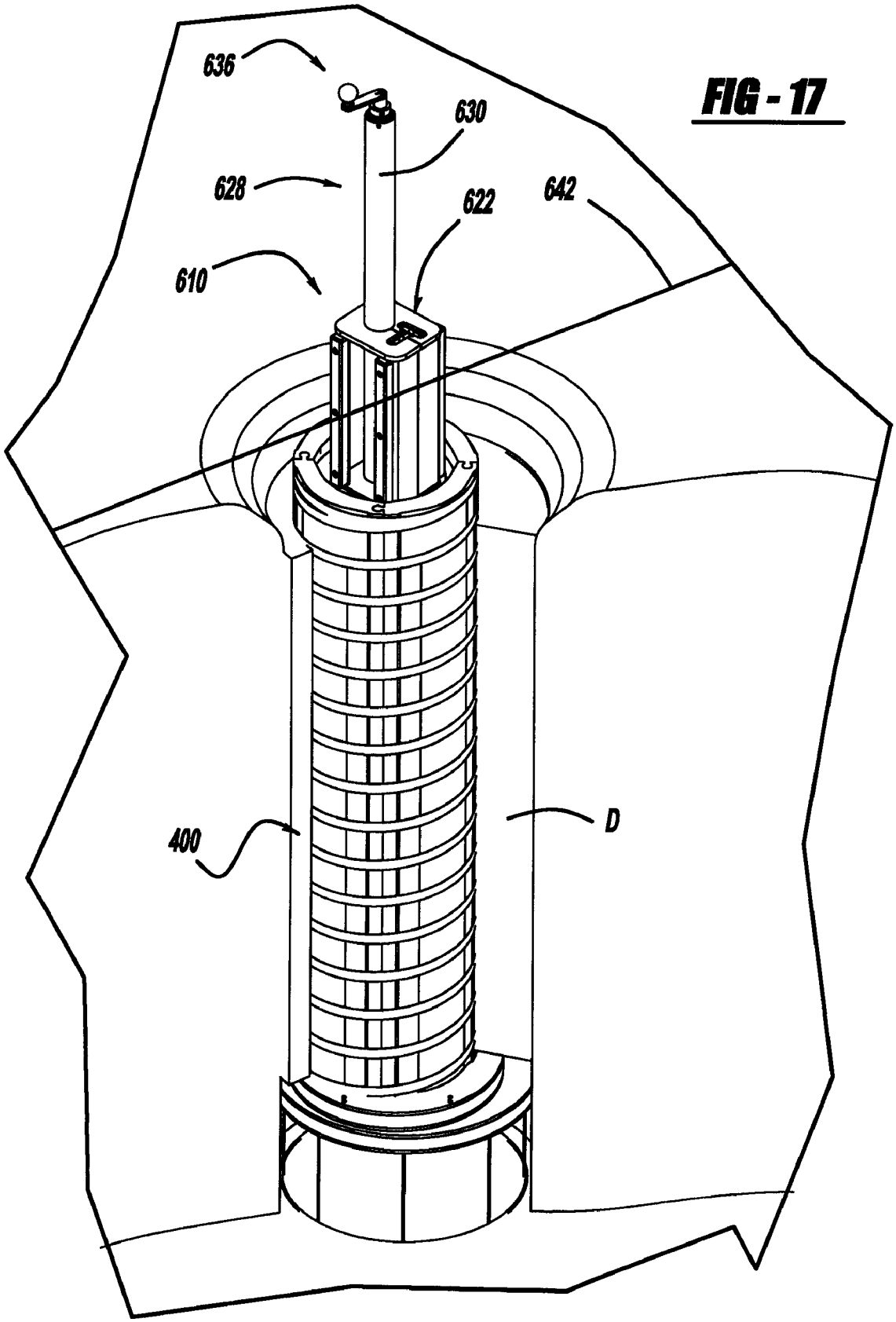
FIG. 17 is a perspective view of the aligning and plumbing tool assembly mounted on the metering pole assembly depicted in FIG. 16, wherein the aligning and plumbing tool assembly has been lowered into the lower vertical form system in situ in an earthen hole, in accordance with a seventeenth embodiment of the present invention.

Referring specifically to FIGS. 16-17, the aligning and plumbing tool assembly 610 and metering pole assembly 628 are placed into the lower vertical form system 400, e.g., such that the lower disk member 634 is tightly or snuggly received against the inner face ID of the lower vertical form system 400. Once the lower disk member 634 is properly situated at a desired depth (e.g., just below the upper edge of the lower vertical form system 400) within the lower vertical form system 400, the rotatable handle member 636 is rotated in an appropriate direction such that the plurality of spike member 640 extend outwardly from the locking box portion 638 such that they penetrate the inner face ID of the lower vertical form system 400, thus preventing vertical movement of the pole member 630. Accordingly, the lower vertical form system 400, or at least the inner face ID thereof, should be constructed of a material that can be relatively easily penetrated by the plurality of spike members 640 (e.g., foams, plastics, and/or the like).

Once the pole member 630 is locked vertically in place, the aligning and plumbing tool assembly 610 is lowered via the upper disk member 632 such that the upper disk member 632 and the lower disk member 634 are brought into close relationship, e.g., abutting relationship, e.g., just below the top edge of the lower vertical form system 400. The upper disk member 632 also preferably fits tightly or snuggly against the inner face ID of the lower vertical form system 400. In this manner, the aligning and plumbing tool assembly 610 is slightly recessed within the inner face ID of the lower vertical form system 400; however, it should be appreciated that the exact depth of the aligning and plumbing tool assembly 610 relative to the inner face ID of the lower vertical form system 400 can be variable depending on the particular circumstances.

The aligning and plumbing tool assembly 610 is then aligned to one or more layout strings 642. Because the pole member 630 is locked to the lower vertical form system 400 with the plurality of spike members 640, the lower vertical form system 400 is also contemporaneously aligned to any layout strings 642, and leveled and/or plumbed according to the two-way bubble level assembly 622 of the aligning and plumbing tool assembly 610. That is, the lower vertical form system 400 is manipulated, if necessary, so as to bring it into level and square with any existing layout strings 642.

By way of a non-limiting example, the pole member 630 can be used to align the inside diameter ID of the lower vertical form system 400 over the offset center hole 202 of the base foam ring member 200 and/or the offset hole 502 of the offset disk member 500. When this is accomplished, the lower vertical form system 400 is plumbed using the two-way bubble level assembly 622 of the aligning and plumbing tool assembly 610. For example, the aligning and plumbing tool assembly 610 is rotated until the side face member 624 is facing the outside of the structure to be constructed. The vertical centering line 626 on the side face member 624 of the aligning and plumbing tool assembly 610 is centered to a marked line on the layout string 642 indicating the center of that proposed concrete column or footing. The side face member 624 of the aligning and plumbing tool assembly 610 is brought to the layout string 642. The lower vertical form system 400 is checked for plumb and the pole member 630 is held in place until the hole is backfilled, e.g., with dirt D.

Figure 18:
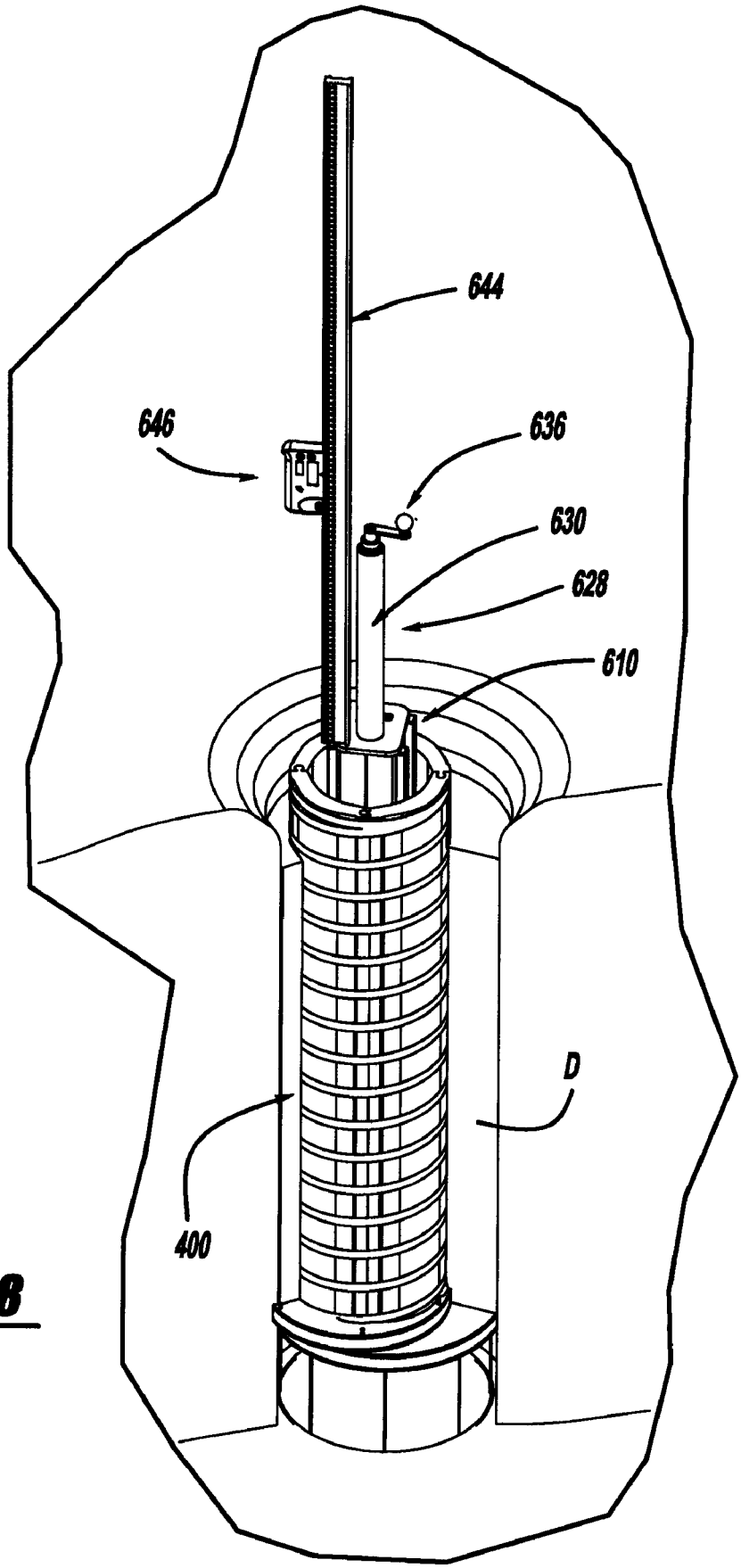
FIG. 18 is a perspective view of a laser transit assembly operably associated with the aligning and plumbing tool assembly mounted on the metering pole assembly depicted in FIG. 16, wherein the aligning and plumbing tool assembly has been lowered into the lower vertical form system in situ in an earthen hole, in accordance with an eighteenth embodiment of the present invention.
Figure 19:
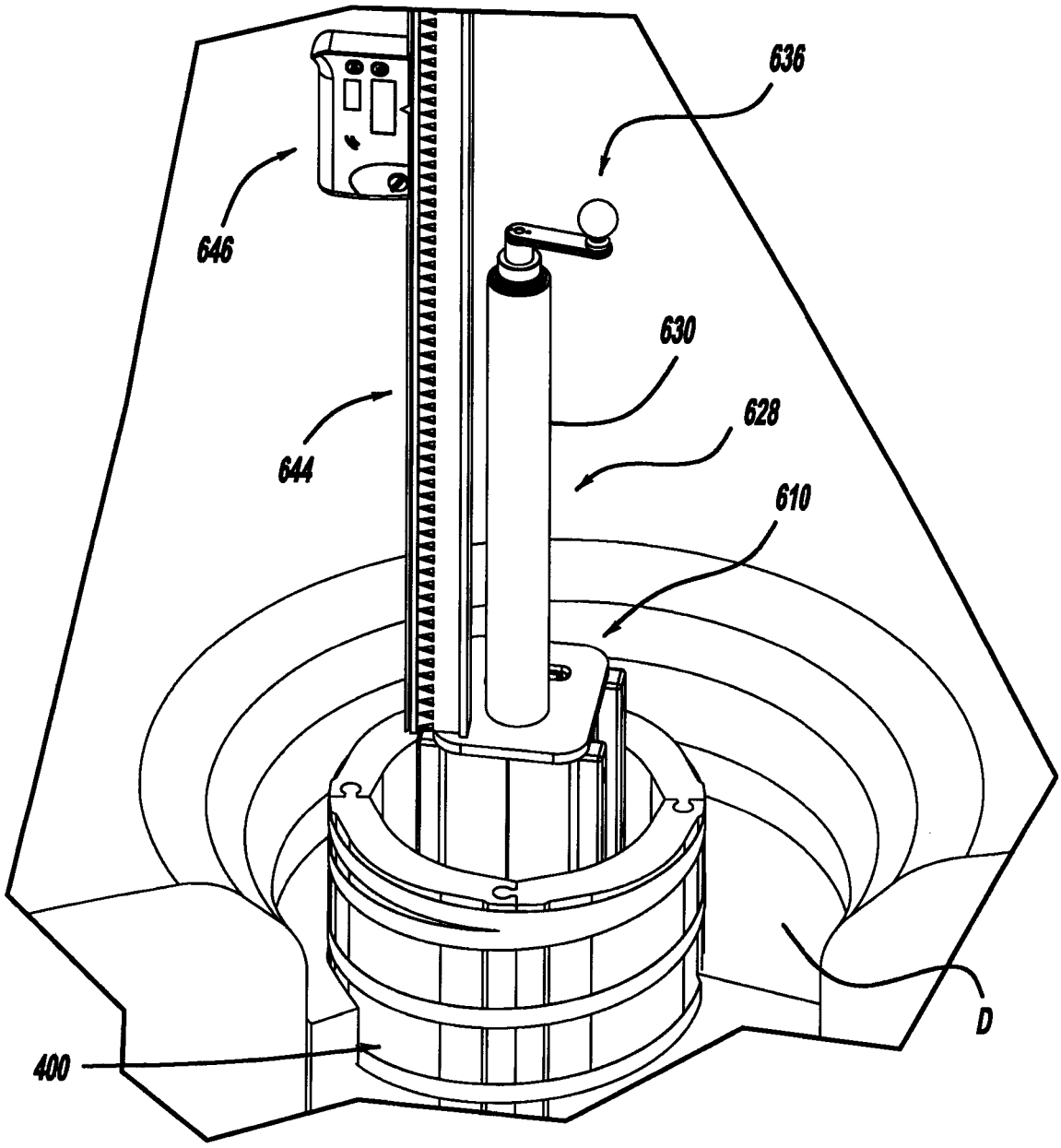
FIG. 19 is a partial detailed view of the laser transit assembly operably associated with the aligning and plumbing tool assembly mounted on the metering pole assembly depicted in FIG. 18, wherein the aligning and plumbing tool assembly has been lowered into the lower vertical form system in situ in an earthen hole, in accordance with a nineteenth embodiment of the present invention.
Figure 20:
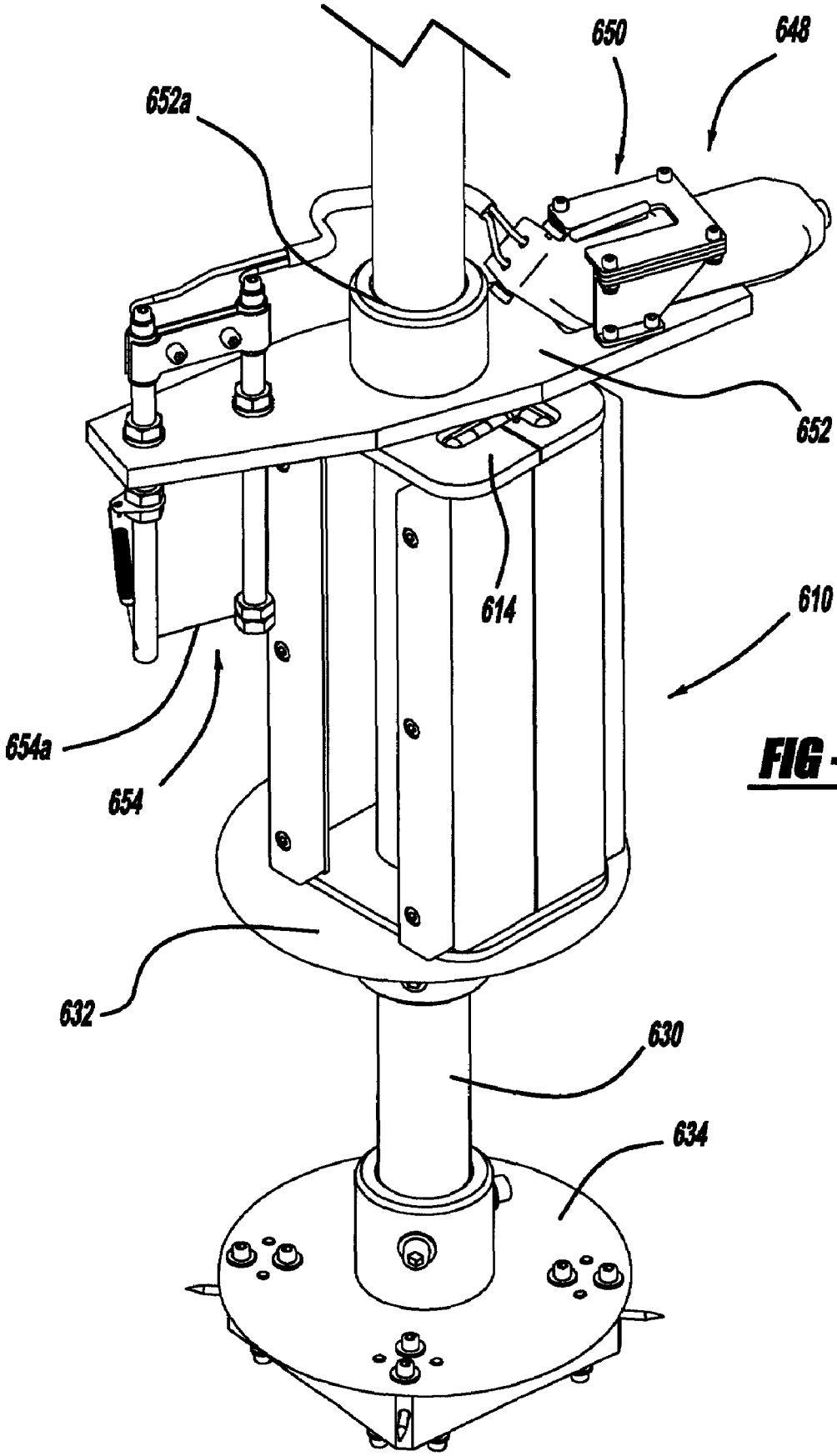
FIG. 20 is a partial detailed view of a hot knife assembly operably associated with the aligning and plumbing tool assembly mounted on the metering pole assembly depicted in FIG. 18, in accordance with a twentieth embodiment of the present invention.
Figure 21:
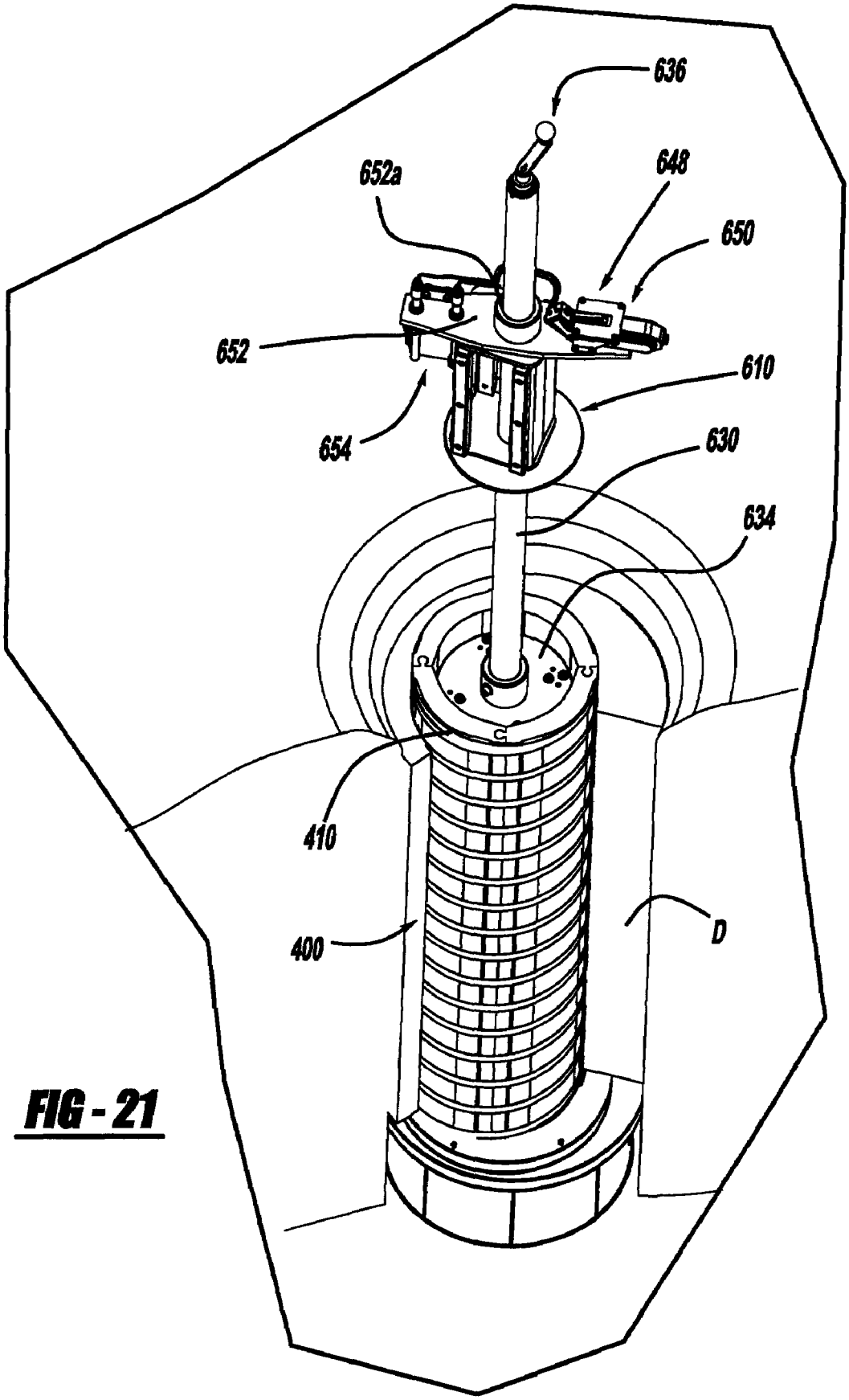
FIG. 21 is a perspective view of the hot knife assembly operably associated with the aligning and plumbing tool assembly mounted on the metering pole assembly depicted in FIG. 20, wherein the aligning and plumbing tool assembly has been lowered into the lower vertical form system in situ in an earthen hole, in accordance with a twenty-first embodiment of the present invention.
Figure 22:
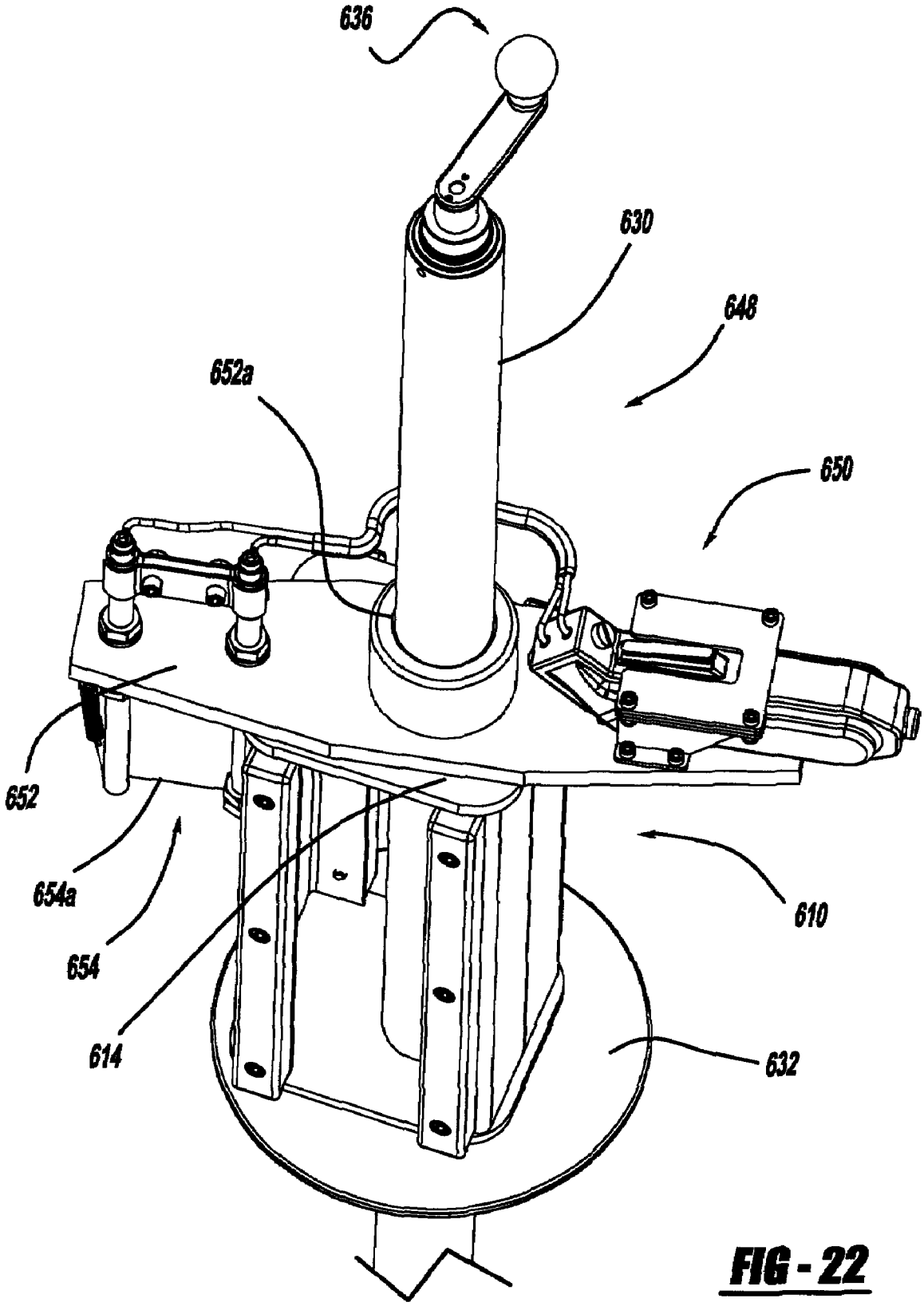
FIG. 22 is a partial detailed view of a top portion of the hot knife assembly operably associated with the aligning and plumbing tool assembly mounted on the metering pole assembly depicted in FIG. 18, in accordance with a twenty-second embodiment of the present invention.
Figure 23:
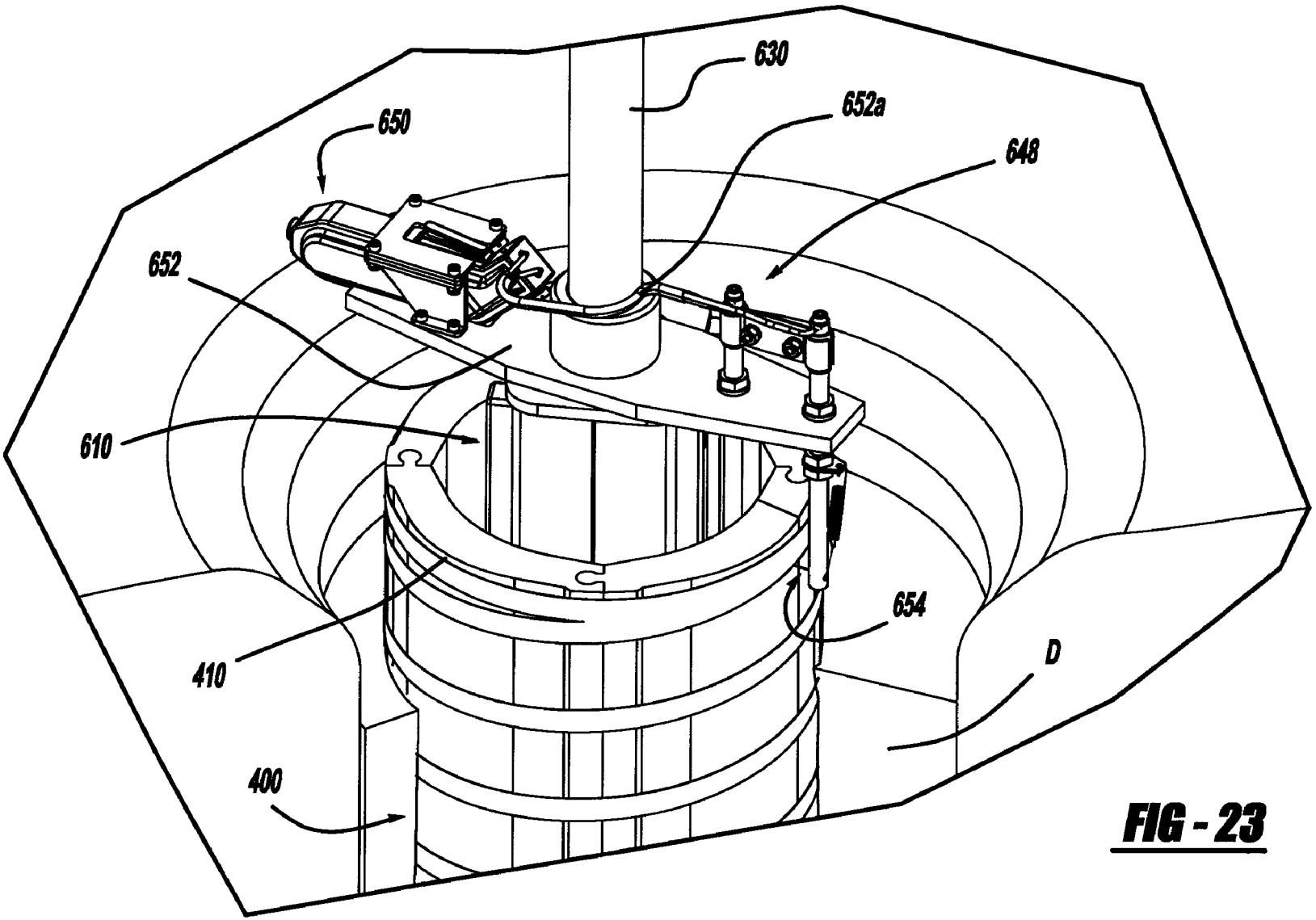
FIG. 23 is a perspective view of the hot knife assembly cutting a top portion of the lower vertical form system to grade, in accordance with a twenty-third embodiment of the present invention.
Figure 24:
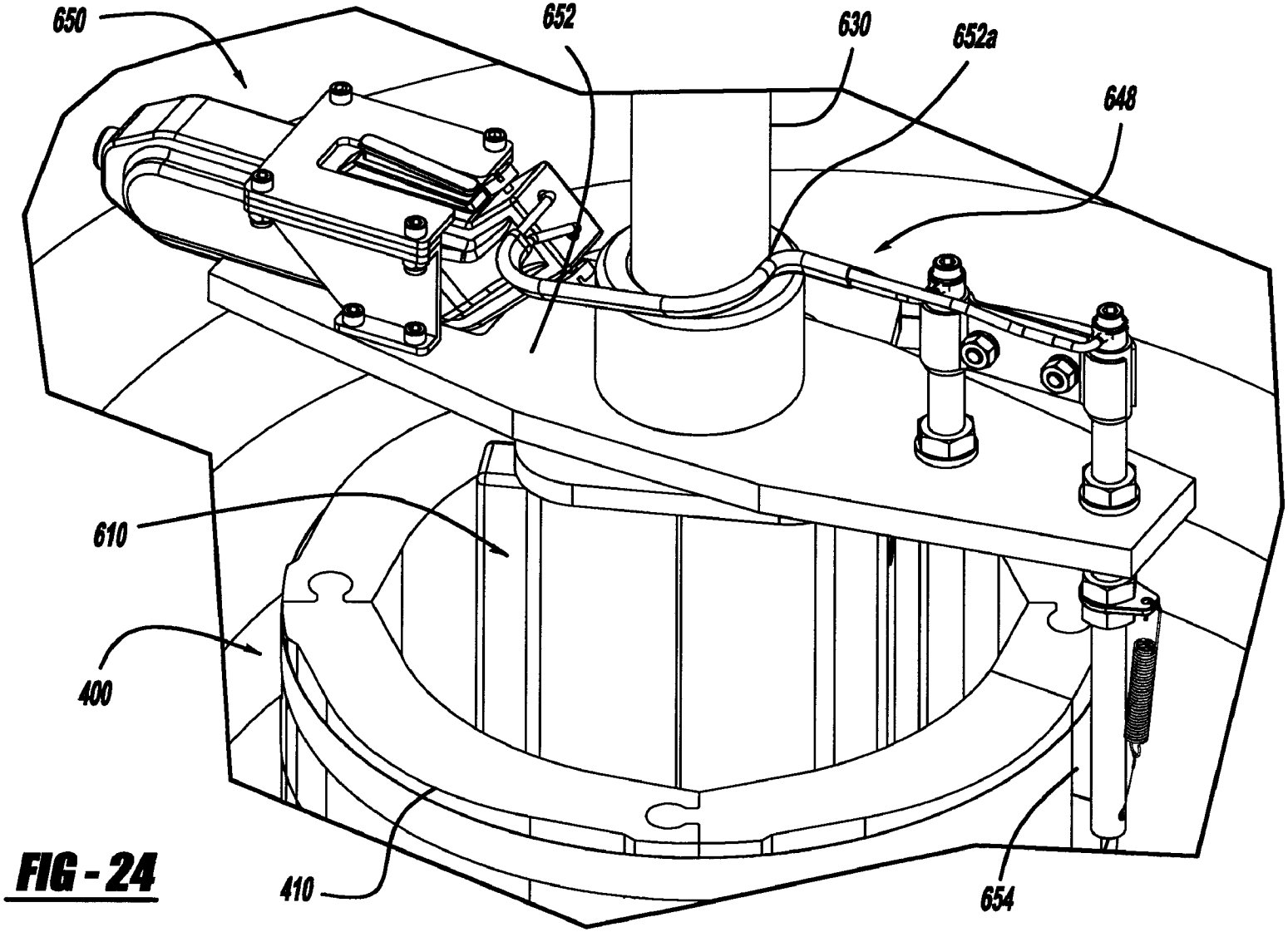
FIG. 24 is a partial detailed view of the hot knife assembly cutting a top portion of the lower vertical form system to grade depicted in FIG. 23, in accordance with a twenty-fourth embodiment of the present invention.

Referring specifically to FIGS. 18-19, the aligning and plumbing tool assembly 610 can also be used to cut the lower vertical form system 400 to grade. By way of a non-limiting example, an optional laser transit rod 644 with an associated detector/sensor 646 can be used to determine the established grade. For example, the laser transit rod 644 is set, at least temporarily, on top of the aligning and plumbing tool assembly 610 (e.g., the upper face member 614) and the aligning and plumbing tool assembly 610 is lowered in the lower vertical form system 400. Of course, this necessitates that the spike members 640 are retracted from the inner face ID of the lower vertical form system 400, thus allowing the aligning and plumbing tool assembly 610 to move freely relative to the pole member 630. When the sensor/detector 646 signals it has detected the appropriate height and/or depth, the aligning and plumbing tool assembly 610 tool is again locked into place, e.g., via the extension of the spike members 640 into the inner face ID of the lower vertical form system 400 by the action of the rotatable handle member 636.

Referring specifically to FIGS. 20-24, the alignment and plumbing tool assembly 610 can include an optional cutting system 648. By way of a non-limiting example, a hot knife system can be used in conjunction with the cutting system 648. The cutting system 648 can include a power source 650, a pivot plate 652 with a center hole 652*a*, and a blade system 654. By way of a non-limiting example, the power source 650 rests on the pivot plate 652, and the blade system 654 extends below the horizontal plane of the pivot plate 652 for cutting the top portion of the lower vertical form system 400 to grade. When the lower vertical form system 400 of the proposed poured concrete column or footing is aligned to the building layout string(s) (e.g., as previously described), the cutting system 648 is downwardly disposed over the pole member 630 (e.g., via center hole 652*a*) to rest on the upper face member 614 of the alignment and plumbing tool assembly 610. Electrical power is then supplied to the power source 650 of the cutting system 648 and the blade system 654, and more specifically blade member 654*a*) of the cutting system 654 radially transverses the upper portion 410 of the lower vertical form system 400 (e.g., rotates 360 degrees around the upper portion 410 of the lower vertical form system 400) so as to cut the lower vertical form system 400 to a predetermined grade.

Once aligned, e.g., as previously described, the lower vertical form system 400 can be secured to the base foam ring member 200 with fasteners 506 which are driven through the bottom face 504 of the offset disk member 500 into the upper face 204 of the base foam ring member 200. By way of a non-limiting example, when the lower vertical form system 400 is in the correct position, a rod or other suitable tool (not shown) can be inserted into the earthen hole 20 and the fasteners 506 in the offset disk member 500 are pushed downwardly into the base foam ring member 200, thus holding the lower vertical form system 400 in place.

As previously described, the earthen hole 20 is backfilled (i.e., the space between the wall of the earthen hole 20 and the outer face OD of the lower vertical form system 400 can be backfilled), e.g., with dirt D, so as to rigidly secure the form system 10 in place such that it would be difficult, if not impossible, to move the form system 10, or any component thereof. Again, as previously described, once secured in this manner, an upper portion 410 of the lower vertical form system 400 is cut to a determined grade, e.g., with a saw, knife, laser, and/or the like.

Figure 25:
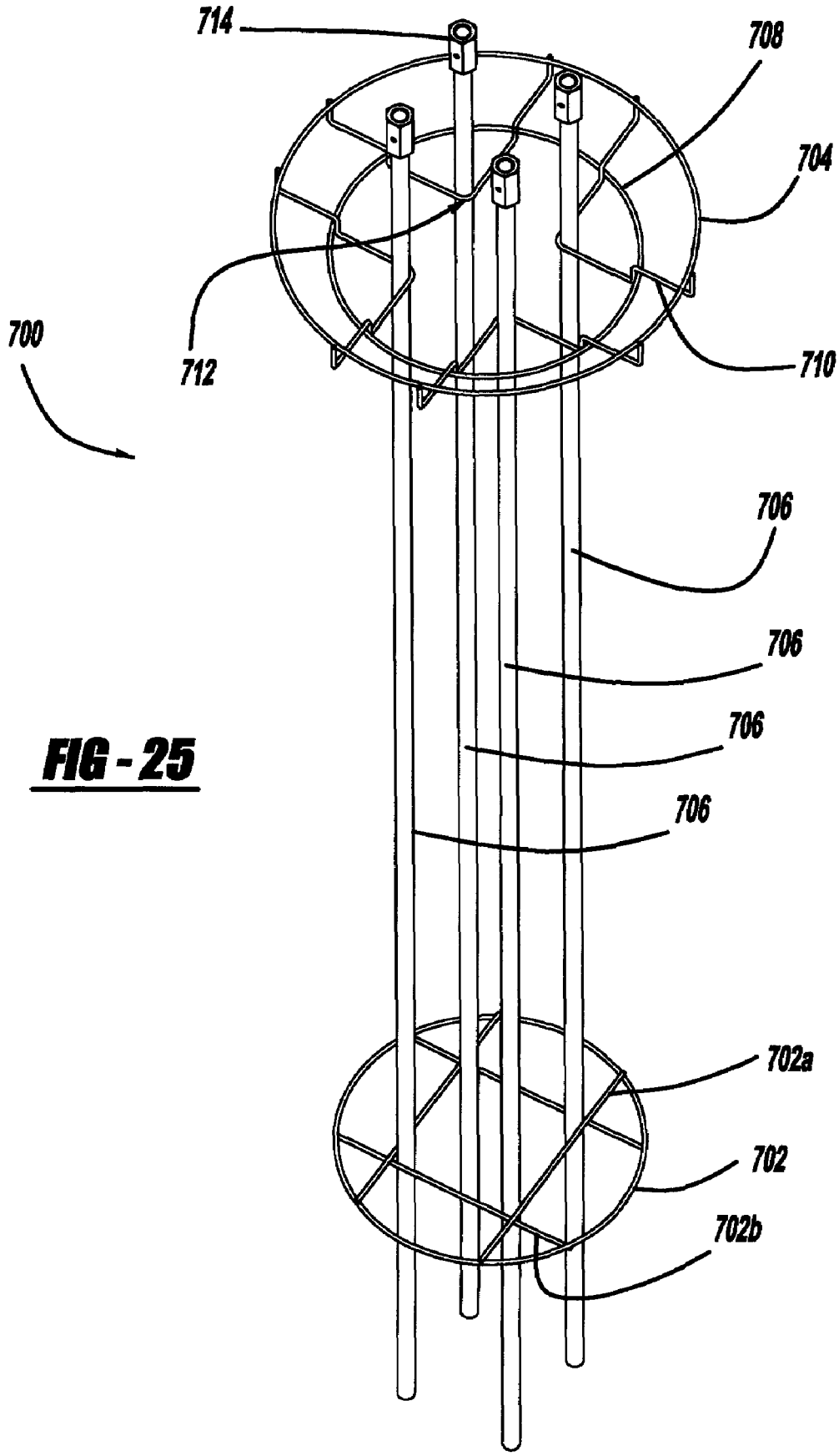
FIG. 25 is a perspective view of a reinforcing assembly, in accordance with a twenty-fifth embodiment of the present invention.
Figure 26:
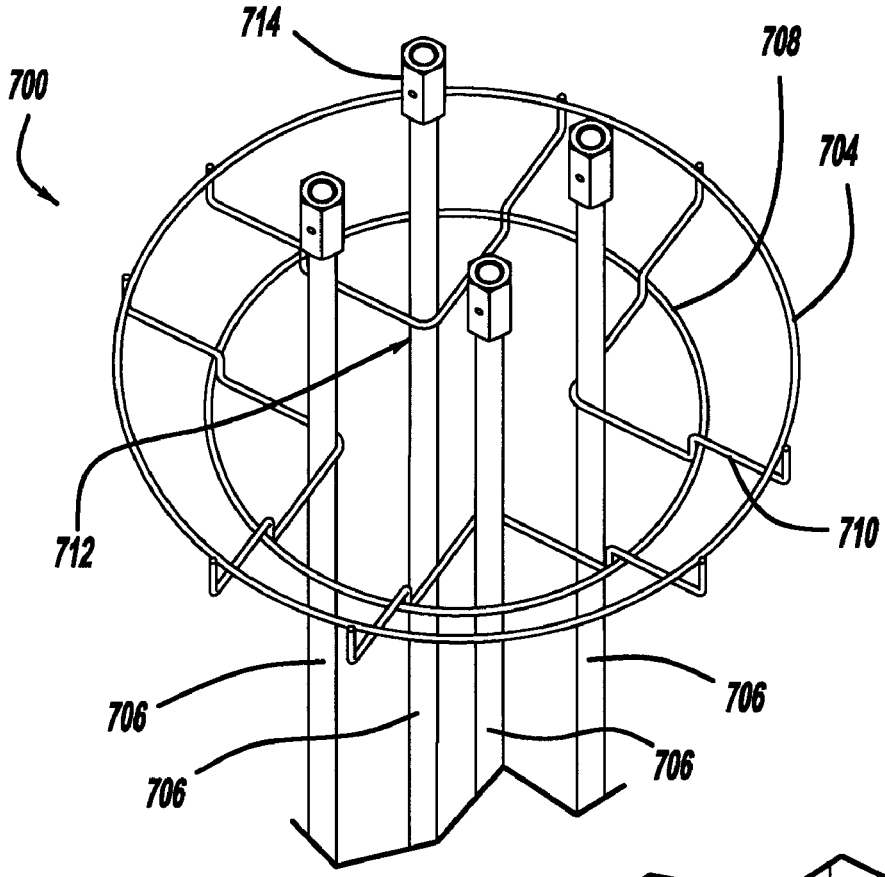
FIG. 26 is a partial perspective view of a top portion of the reinforcing assembly depicted in FIG. 25, in accordance with a twenty-sixth embodiment of the present invention.
Figure 27:
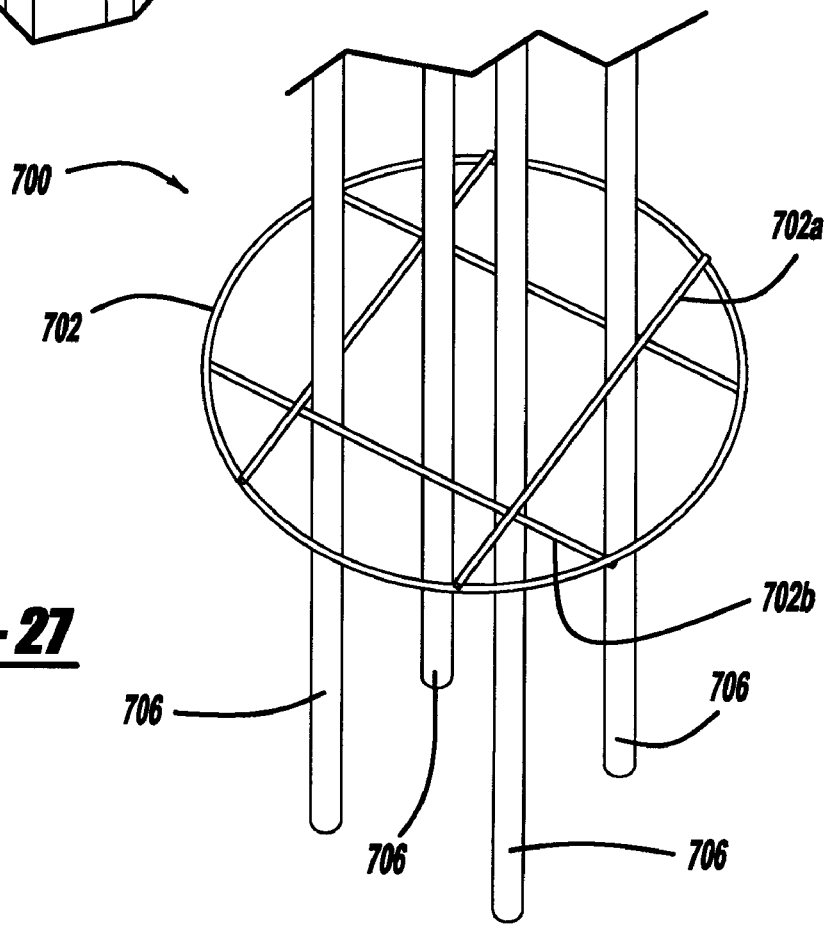
FIG. 27 is a partial perspective view of a bottom portion of the reinforcing assembly depicted in FIG. 25, in accordance with a twenty-seventh embodiment of the present invention.

Referring to FIGS. 25-27, a reinforcing assembly 700 can be employed in conjunction with the form system 10 of the present invention. By way of a non-limiting example, the reinforcing assembly 700 can provide reinforcement to the concrete column or footing 30 that is to be formed. The reinforcing assembly 700 can be comprised of any number of materials, such as but not limited to metals. By way of a non-limiting example, the reinforcing assembly 700 can be comprised of #5 rebar; however, it should be appreciated that many other different types, styles, and gauges of metallic materials can be employed in the practice of the present invention.

In accordance with one aspect of the present invention, the reinforcing assembly 700 includes a lower ring member 702, a spaced and opposed upper ring member 704, and a plurality of reinforcement members 706 extending from and through either or both of the lower ring member 702 and/or upper ring member 704. By way of a non-limiting example, the plurality of reinforcement members 706 can be fastened (e.g., welded) to a surface of the lower ring member 702, such as bisecting cross members 702*a*, 702*b*, respectively. The upper ring member 704 can include an inner ring member 708 interconnected by a plurality of loop members 710, a surface of which can be fastened (e.g., welded) to a surface of the upper ring member 704 and/or the inner ring member 708. The reinforcement members 706 can rest upon the vertices 712 of the loop members 710 or can alternatively be fastened (e.g., welded) to a surface of the vertices 712. The ends of the reinforcement members 706 can be provided with attachment members 714, e.g., for facilitating attachment of additional components of the form system 10.

Figure 28:
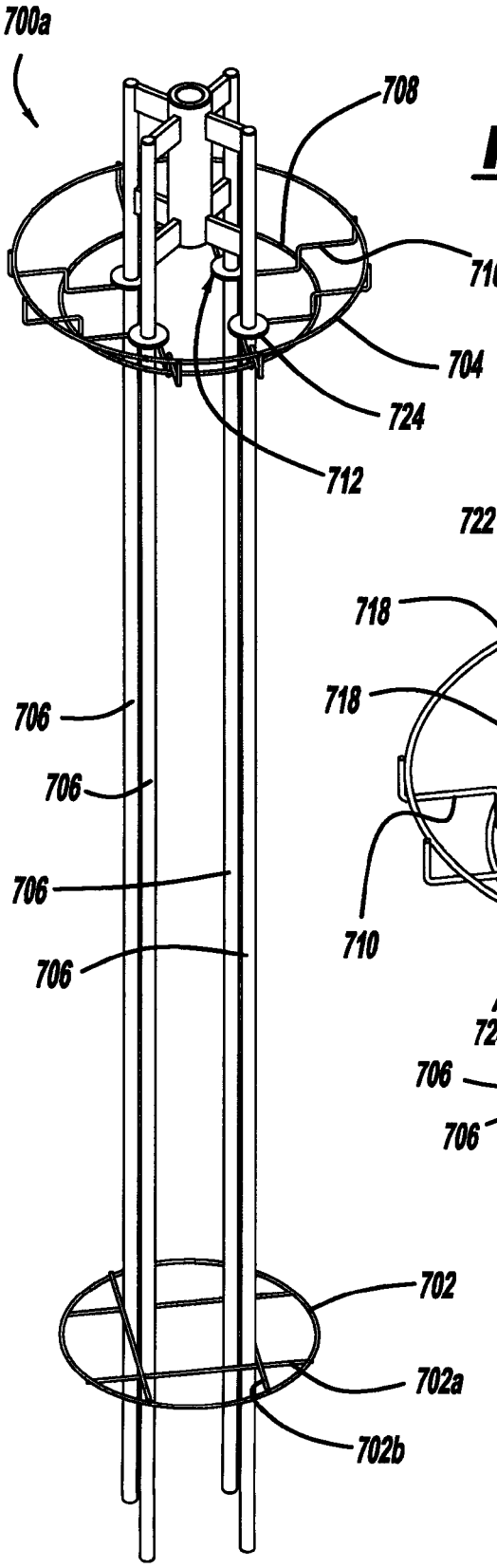
FIG. 28 is a perspective view of an alternative reinforcing assembly, in accordance with a twenty-eighth embodiment of the present invention.
Figure 29:
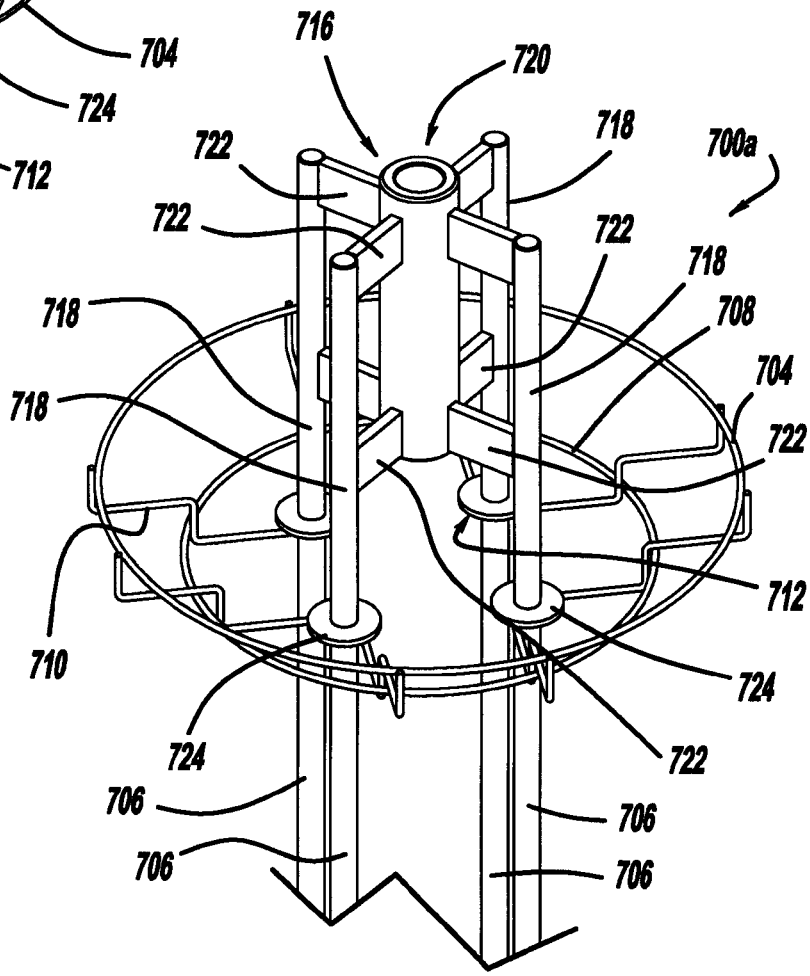
FIG. 29 is a partial perspective view of a top portion of the alternative reinforcing assembly depicted in FIG. 28, in accordance with a twenty-ninth embodiment of the present invention.
Figure 30:
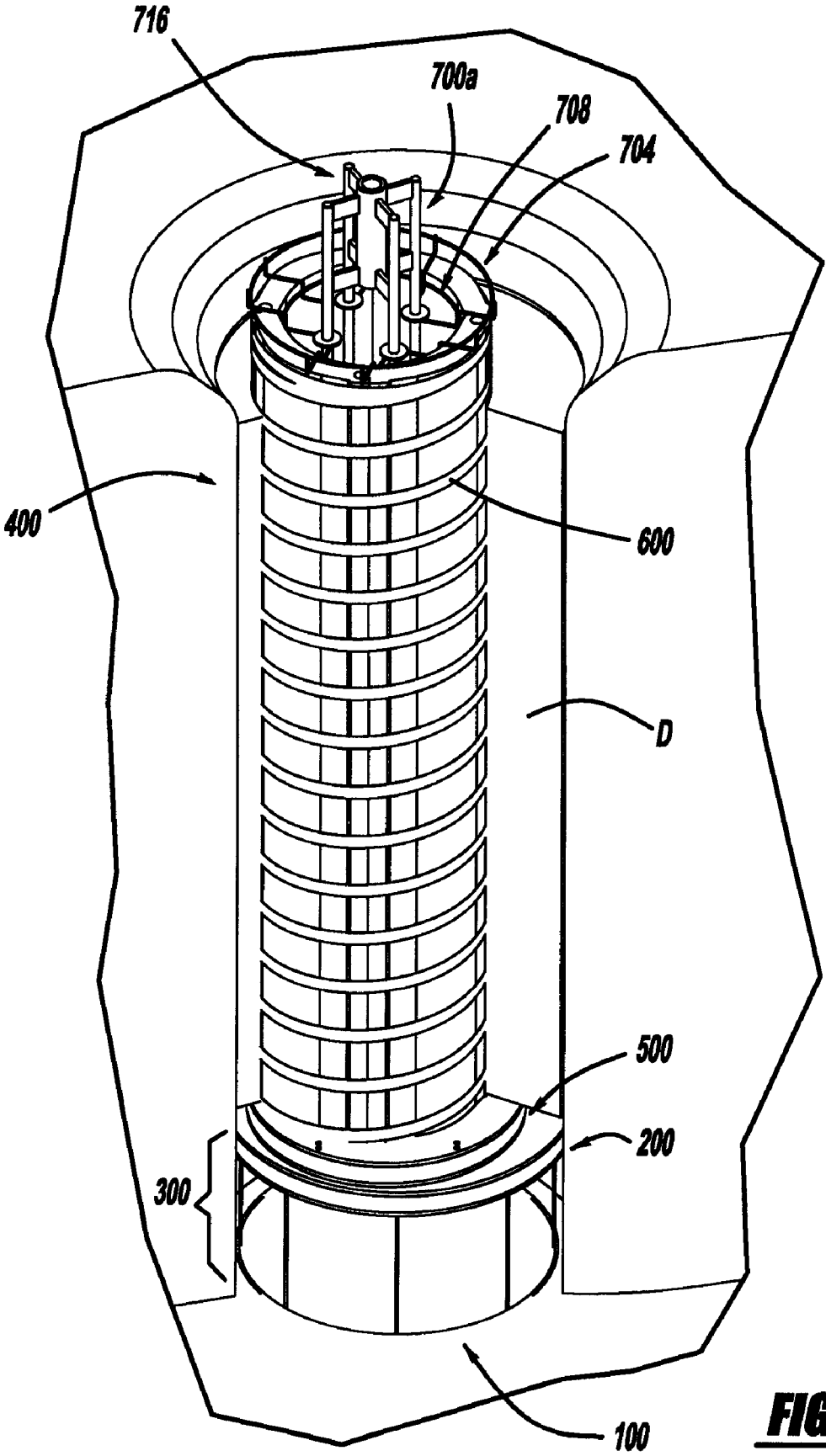
FIG. 30 is a perspective view of the alternative reinforcing assembly disposed within the lower vertical form system depicted in FIG. 24, in situ in an earthen hole, in accordance with a thirtieth embodiment of the present invention.
Figure 31:
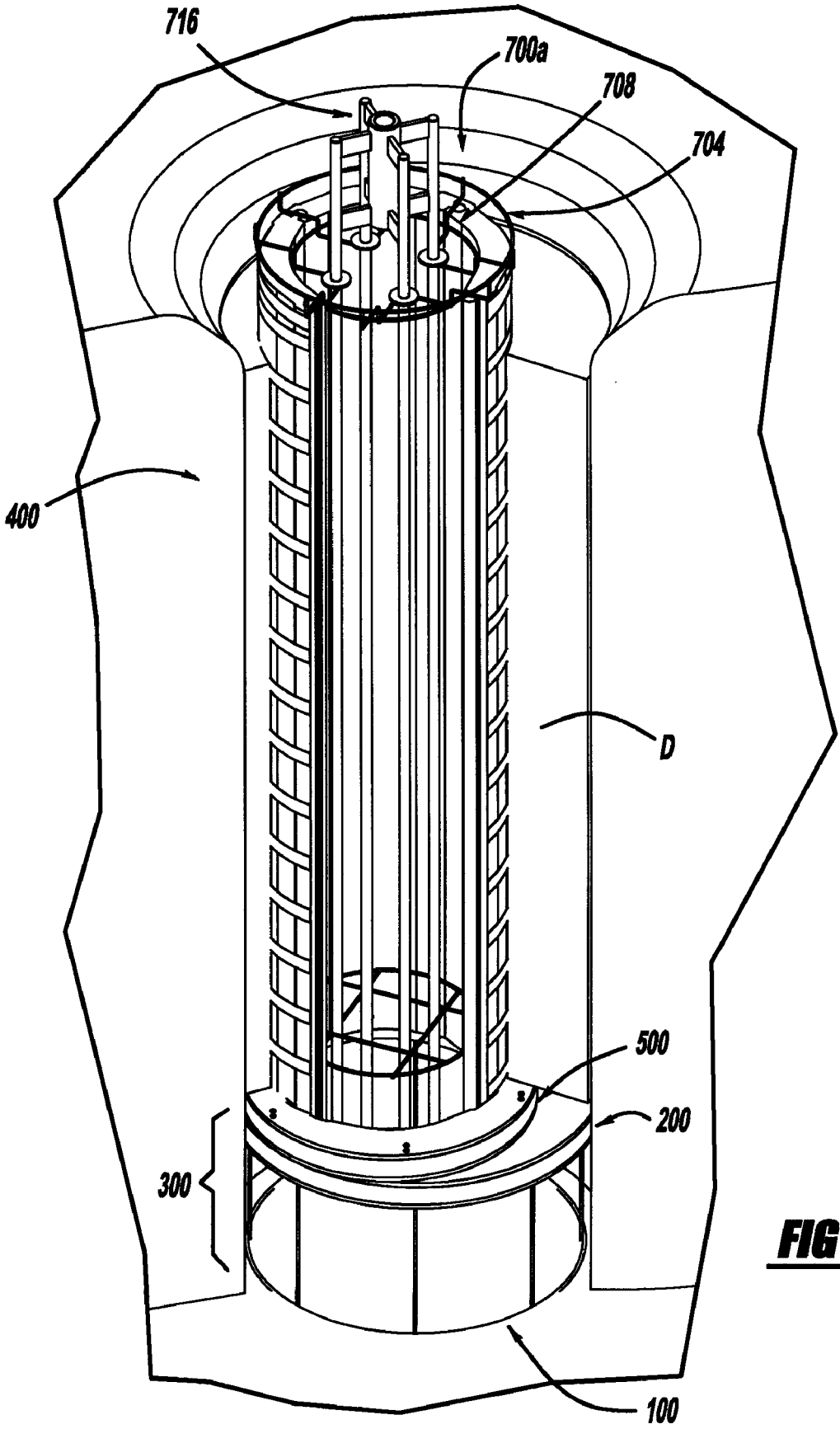
FIG. 31 is a partial broken away view of the alternative reinforcing assembly disposed within the lower vertical form system depicted in FIG. 30, in situ in an earthen hole, in accordance with a thirty-first embodiment of the present invention.
Figure 32:
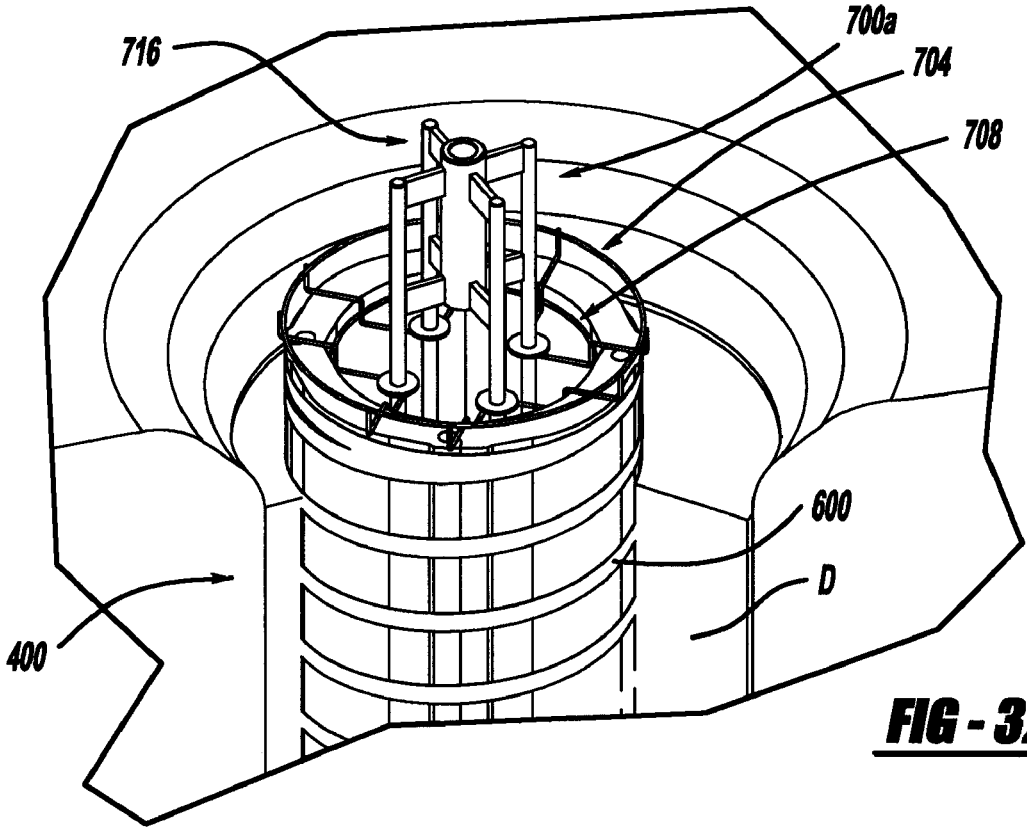
FIG. 32 is a partial perspective view of a top portion of the alternative reinforcing assembly disposed in the lower vertical form system depicted in FIG. 31, in accordance with a thirty-second embodiment of the present invention.
Figure 33:
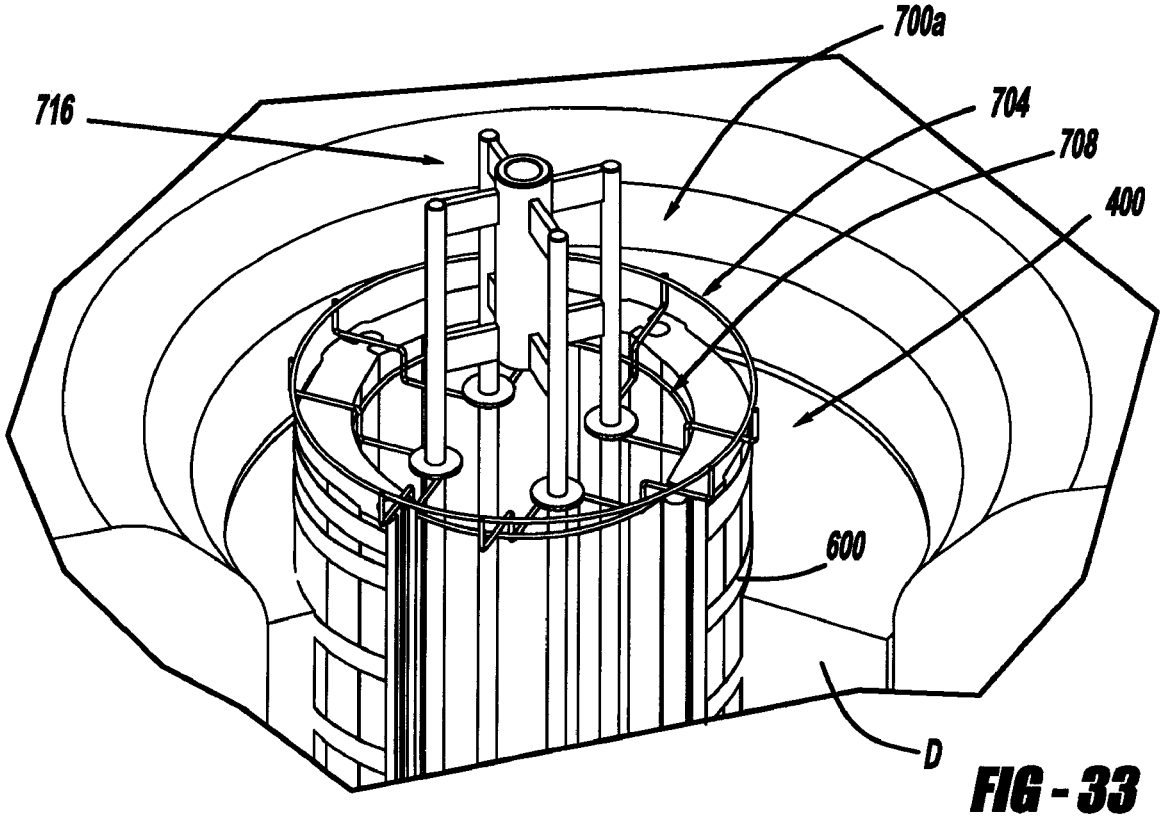
FIG. 33 is a partial broken away view of the top portion of the alternative reinforcing assembly disposed in the lower vertical form system depicted in FIG. 31, in accordance with a thirty-third embodiment of the present invention.
Figure 34:
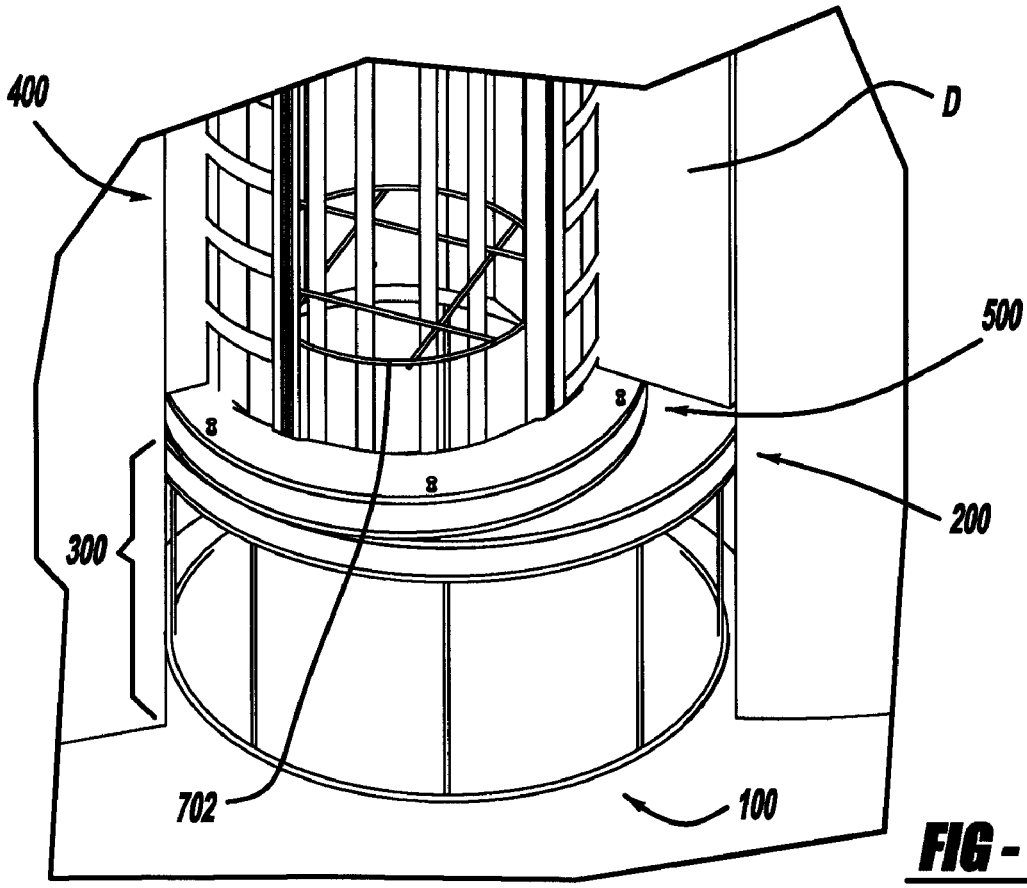
FIG. 34 is a partial broken away view of a bottom portion of the alternative reinforcing assembly disposed in the lower vertical form system depicted in FIG. 31, in accordance with a thirty-fourth embodiment of the present invention.

Referring specifically to FIGS. 28-29, an alternative reinforcing assembly 700*a* includes a column bracket member 716. The intended purpose of the column bracket member 716 is to mate with the ends, specifically the attachment members 714, of the reinforcement members 706 so as to add stability and rigidity to the reinforcing assembly 700*a*. The column bracket 716 includes four generally cylindrical members 718 that are connected to a central cylindrical member 720 via a plurality of cross members 722. The cylindrical members 718 can telescopically mate with the attachment members 714 of the reinforcing members 706, e.g., the cylindrical members 718 can include an open end having an associated bore or cavity. A plurality of washer members 724 can be provided about the attachment members 714 such that they engage a surface of the vertices 712, which in turn can provide support to the cylindrical members 718 resting thereupon.

Referring specifically to FIGS. 30-34, once the lower vertical form system 400 has been properly positioned and its length has been cut to grade, the reinforcing assembly 700*a* can be inserted into the lower vertical form system 400 such that the column bracket 716 extends above the upper edge of the lower vertical form system 400. Additionally, the diameter of the reinforcing assembly 700*a* can be sized so as to abut against or nearly abut against the inner face ID of the lower vertical form system 400 such that there is not excessive room between the exterior surface of the reinforcing assembly 700*a* and the inner face ID of the lower vertical form system 400. The upper ring member 704 can function as a top positioning cage of the reinforcing assembly 700*a* and centers and holds the reinforcing assembly 700*a* at the right height relative to the upper edge of the lower vertical form system 400.

Figure 35:
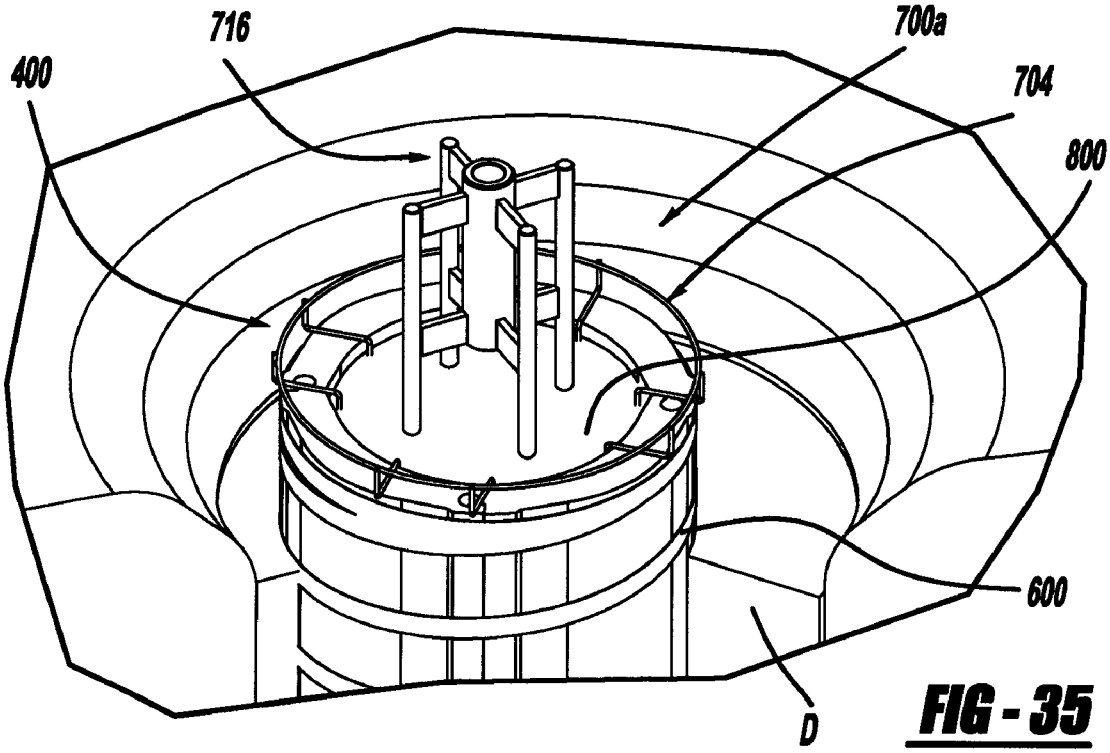
FIG. 35 is a perspective view of the top portion of the alternative reinforcing assembly disposed in the lower vertical form system depicted in FIG. 31 after concrete has been introduced into the vertical form system, in accordance with a thirty-fifth embodiment of the present invention.
Figure 36:
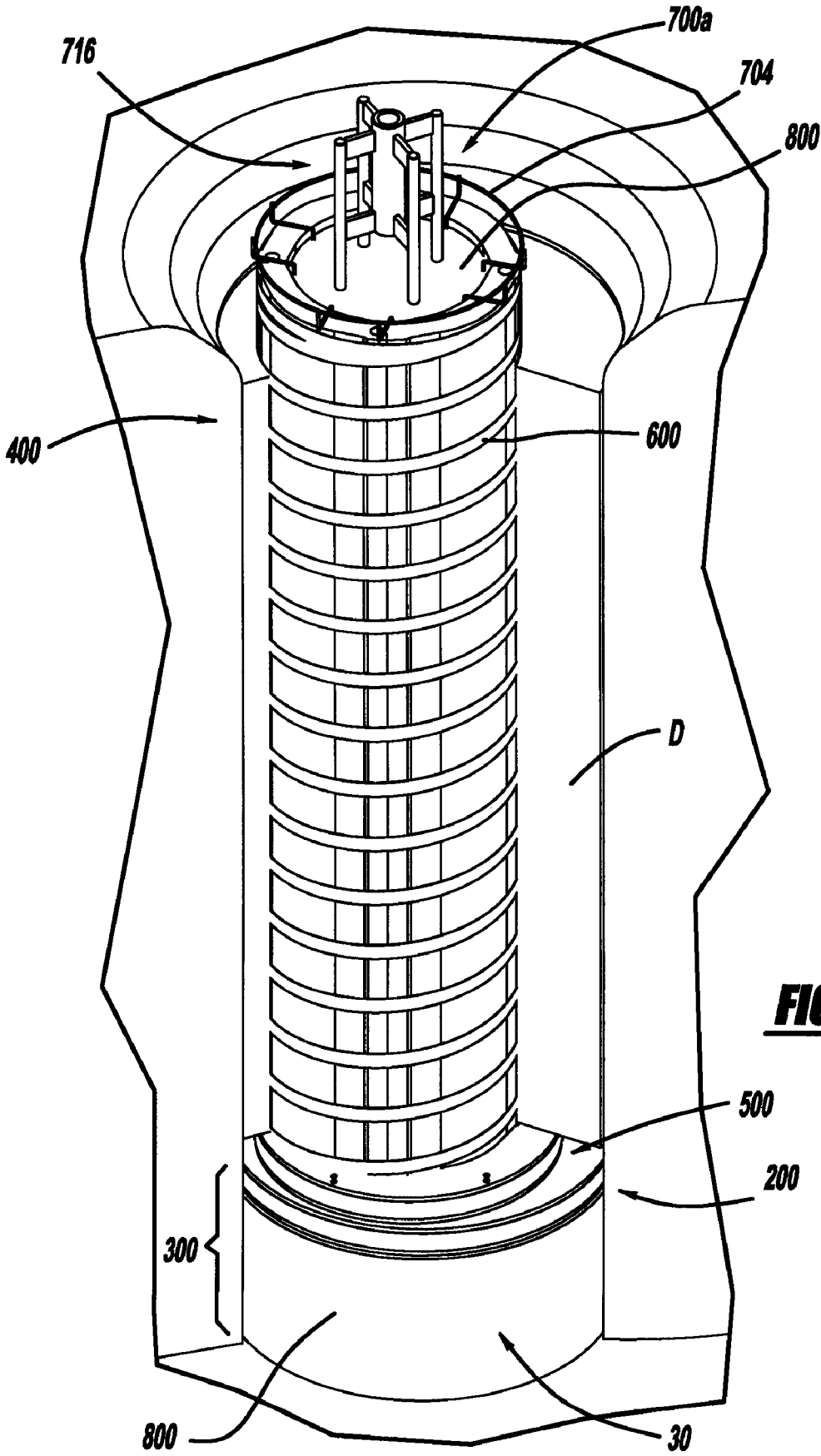
FIG. 36 is a perspective view of the alternative reinforcing assembly disposed in the lower vertical form system depicted in FIG. 31 after concrete has been introduced into the vertical form system, in situ in an earthen hole, in accordance with a thirty-sixth embodiment of the present invention.
Figure 37:
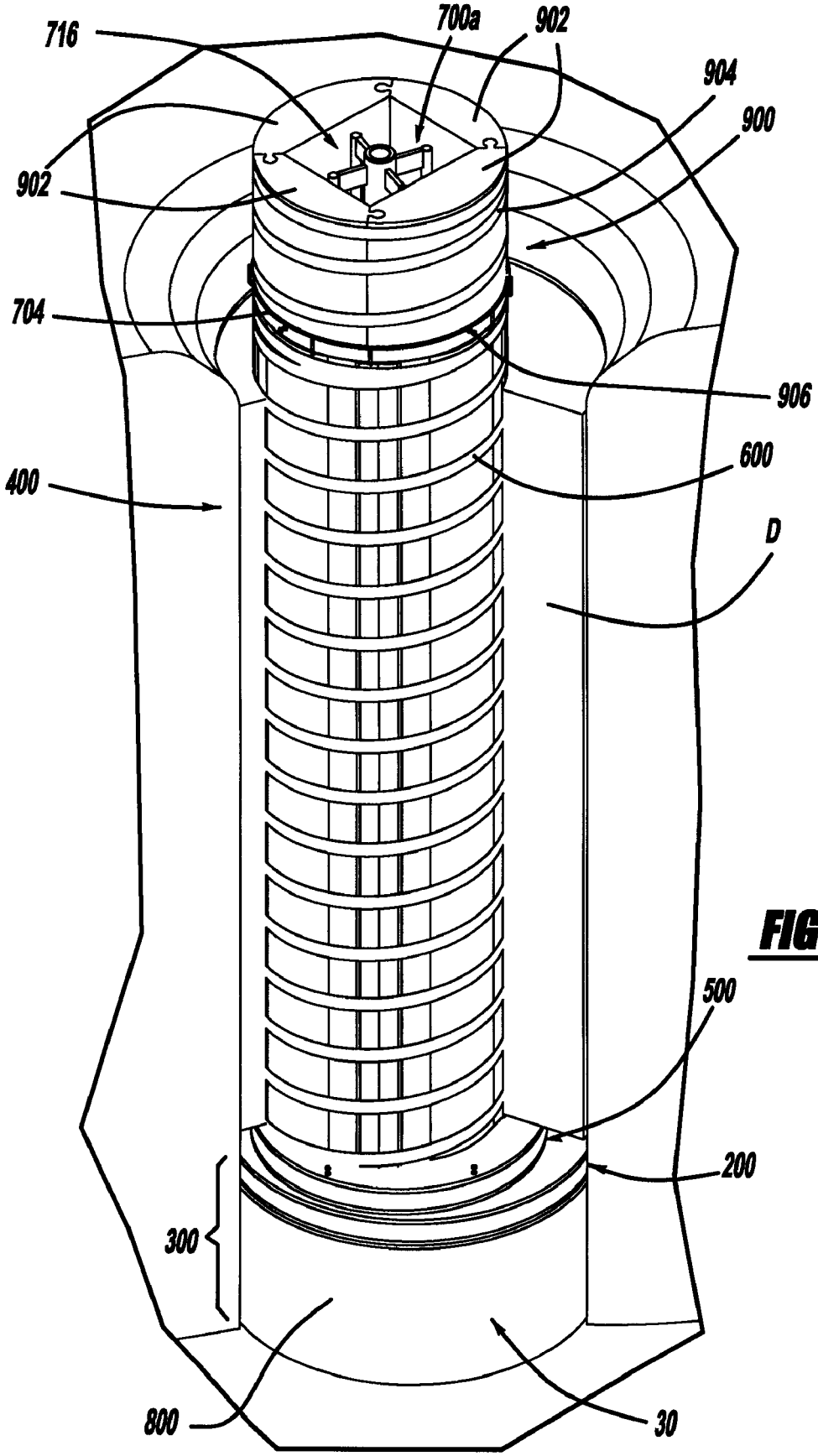
FIG. 37 is a perspective view of an upper vertical form system disposed on top of the lower vertical form system depicted in FIG. 36, in situ in an earthen hole, in accordance with a thirty-seventh embodiment of the present invention.
Figure 38:
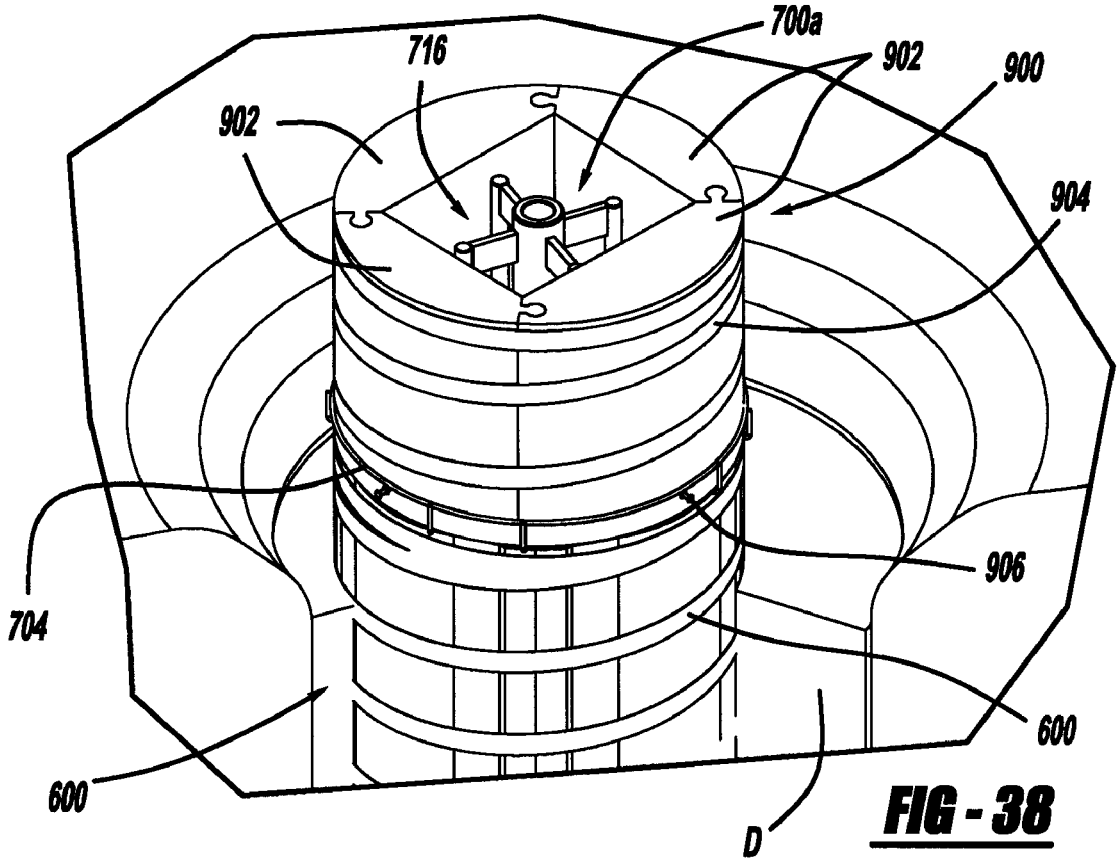
FIG. 38 is a partial perspective view of the upper vertical form system disposed on top of the lower vertical form system depicted in FIG. 36, in accordance with a thirty-eighth embodiment of the present invention.
Figure 39:
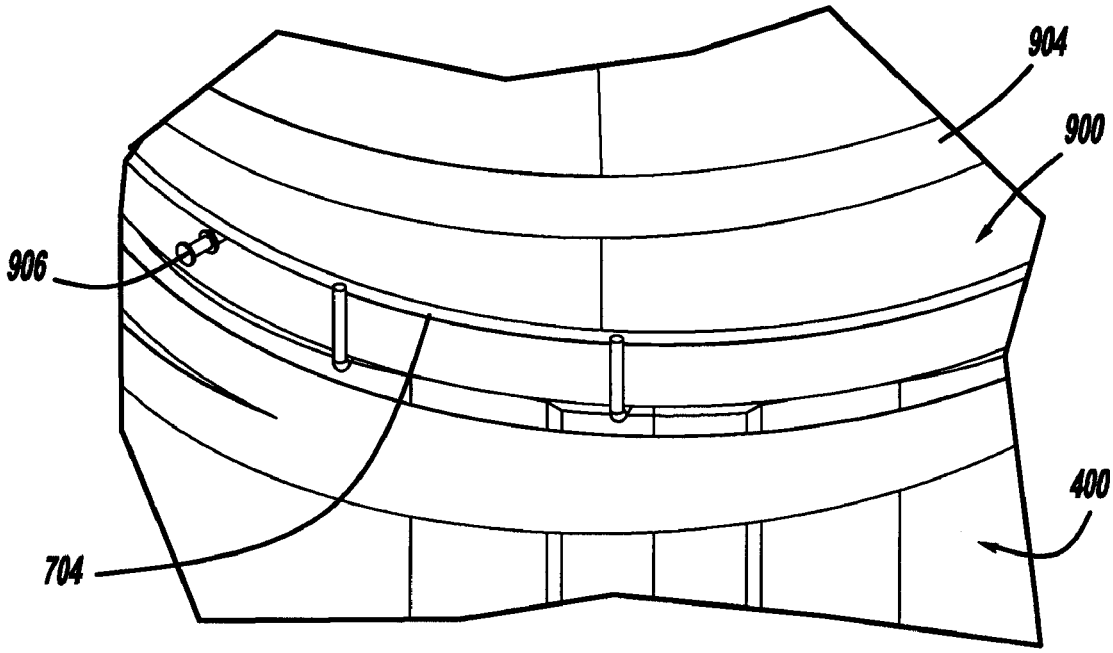
FIG. 39 is a partial perspective view of a detailed section of the upper vertical form system disposed on top of the lower vertical form system depicted in FIG. 36, in accordance with a thirty-ninth embodiment of the present invention.
Figure 40:
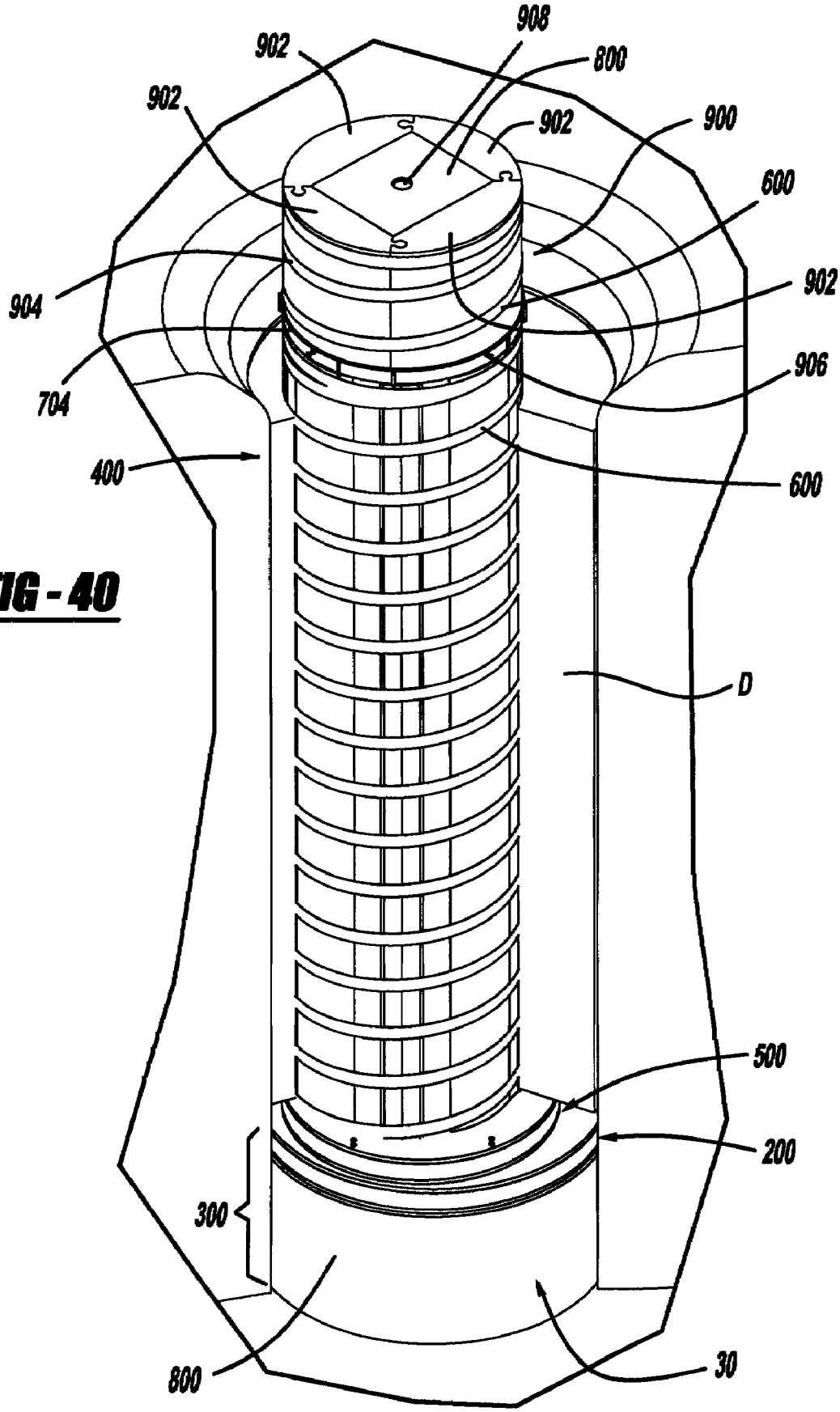
FIG. 40 is a perspective view of the upper vertical form system disposed on top of the lower vertical form system depicted in FIG. 36 after concrete has been introduced into the upper vertical form system, in situ in an earthen hole, in accordance with a fortieth embodiment of the present invention.
Figure 41:
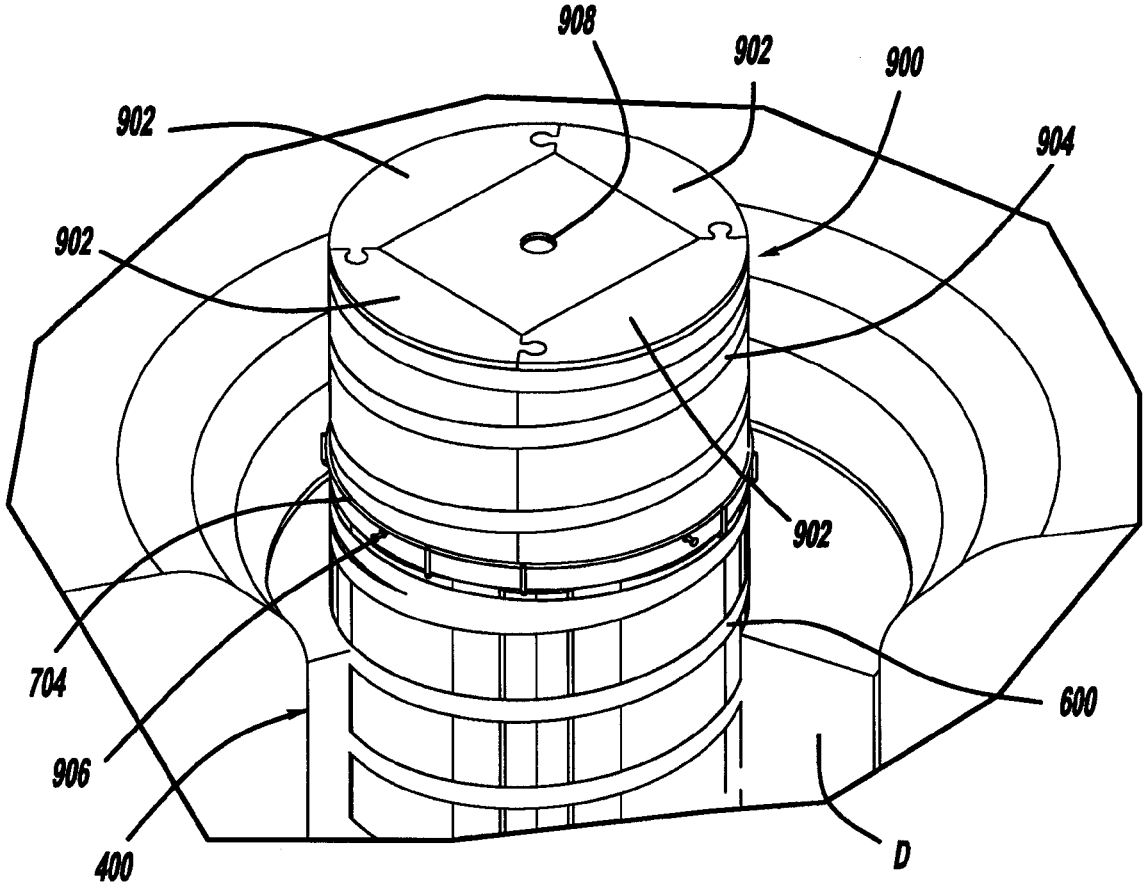
FIG. 41 is a partial perspective view of the upper vertical form system disposed on top of the lower vertical form system depicted in FIG. 36 after concrete has been introduced into the upper vertical form system, in accordance with a forty-first embodiment of the present invention.

Referring specifically to FIGS. 35-36, a sufficient amount of concrete 800 (e.g., in the form of a liquid, slurry and/or the like) can then be poured into the lower vertical form system 400 and filled close to the upper edge of the lower vertical form system 400. The concrete 800 preferably infiltrates all the way down the lower vertical form system 400 to completely fill the lower portion of the earthen hole 20, especially in the area of the support assembly 300. In this manner, the lower portion of the concrete column or footing 30 can be formed.

Referring specifically to FIGS. 37-41, an upper vertical form system 900 includes a plurality of interlocking sections 902 (e.g., employing a tongue and groove arrangement) that are optionally taped together (e.g., using adhesive or filament tape 904) for added stability and rigidity. The upper vertical form system 900 can then be placed on top of the lower vertical form system 400. The upper vertical form system 900 can be held in place by the upper ring member 704 (e.g., the top positioning cage portion thereof).

As with the lower vertical form system 400, it is important that the upper vertical form system 900 is properly plumbed and aligned. By way of a non-limiting example, the upper vertical form system 900 can be lined up with any layout strings and squared to the associated building or structure. Fasteners 906 (e.g., nails, screws, bolts, and/or the like) are pushed into the surface of the upper vertical form system 900 under the outside wire 704*a* of the upper ring member 704 so as to keep the upper vertical form system 900 in place. One or more optional plug caps (not shown) can be inserted into one or more attaching points 908 so as to keep them clean and free from any poured concrete 800. A sufficient amount of additional concrete 800 (e.g., in the form of a liquid, slurry and/or the like) can then be poured into the upper vertical form system 900 and filled close to the upper edge of the upper vertical form system 900. In this manner, the upper portion of the concrete column or footing 30 can be formed.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A system for aligning, leveling or plumbing a vertical form system for forming a structural element in situ in an earthen hole, comprising:

a metering pole assembly, comprising:

a metering pole member; and a selectively operable fastening system located at a first end of the metering pole member; and an alignment assembly, comprising:

a first face member having an area defining a first aperture formed therein; and a second face member having an area defining a second aperture formed therein;

wherein the first and second face members are held in fixed relationship with respect to one another such that the first and second apertures are substantially axially aligned;

wherein either the first or second face members includes a level system operably associated therewith, wherein the level system is operable to determine a characteristic of the vertical form system selected from the group consisting of level, plumb, and combinations thereof;

wherein the first and second apertures are operable to receive a second end of the metering pole member such that the alignment assembly is disposed about and releaseably mated to the metering pole assembly;

wherein the alignment assembly is selectively operable to rotate about the metering pole member and travel along a length of the metering pole member;

wherein the mated metering pole member and alignment assembly are selectively operable to be received within an annular inner face formed in the vertical form system;

wherein the fastening system is selectively operable to deploy a fastening member into the inner face of the vertical form system so as to maintain the metering pole member and the alignment assembly in fixed relationship with the vertical form system.

2. The invention according to claim 1, further comprising:

a first disk member disposed about the metering pole member; and a second disk member disposed about the metering pole member, wherein the first and second disk members are spaced apart, wherein the second disk member is located proximate to the first end of the metering pole member;

wherein the fastening system is adjacent to the second disk member;

wherein either the first or second disks abut against the inner face of the vertical form system.

3. The invention according to claim 2, wherein the alignment assembly rests upon the first disk member.

4. The invention according to claim 1, further comprising a side face member disposed between the first and second face members, wherein either the first or side face members include a centering line disposed on a surface thereof.

5. The invention according to claim 1, further comprising a rotatable handle member operably associated with the metering pole member and the fastening system, wherein the rotatable handle member is selectively operable to deploy the fastening member when the handle member is rotated in a first direction and selectively operable to retract the fastening member when the handle member is rotated in a second direction.

6. The invention according to claim 1, further comprising a transit system releasably disposed on the first face member, wherein the transit system is selectively operable to determine a grade level for the vertical form system.

7. The invention according to claim 1, further comprising a cutting system rotatably disposed about the metering pole member and resting on the first face member, wherein the cutting system is selectively operable to cut an annular top portion of the vertical form system to a grade level.

8. The invention according to claim 7, wherein the vertical form system is either aligned, leveled or plumbed when the alignment assembly is fixed relative to a first height of the vertical form system and the annular top portion of the vertical form system is cut when the alignment assembly is fixed relative to a second height of the vertical form system.

9. A system for aligning, leveling or plumbing a vertical form system for forming a structural element in situ in an earthen hole, comprising:

a metering pole assembly, comprising:

a metering pole member;

a first disk member disposed about the metering pole member;

a second disk member disposed about the metering pole member, wherein the first and second disk members are spaced apart, wherein the second disk member is located proximate to a first end of the metering pole member;

a selectively operable fastening system adjacent to the second disk member, wherein the fastening system is located at the first end of the metering pole member; and an alignment assembly, comprising:

a first face member having an area defining a first aperture formed therein; and a second face member having an area defining a second aperture formed therein;

wherein the first and second face members are held in fixed relationship with respect to one another such that the first and second apertures are substantially axially aligned;

wherein either the first or second face members includes a level system operably associated therewith, wherein the level system is operable to determine a characteristic of the vertical form system selected from the group consisting of level, plumb, and combinations thereof;

wherein the first and second apertures are operable to receive a second end of the metering pole member such that the alignment assembly rests upon the first disk member and is disposed about and releaseably mated to the metering pole assembly;

wherein the alignment assembly is selectively operable to rotate about the metering pole member and travel along a length of the metering pole member;

wherein the mated metering pole member and alignment assembly are selectively operable to be received within an annular inner face formed in the vertical form system;

wherein the fastening system is selectively operable to deploy a fastening member into the inner face of the vertical form system so as to maintain the metering pole member and the alignment assembly in fixed relationship with the vertical form system; and a cutting system rotatably disposed about the metering pole member and resting on the first face member, wherein the cutting system is selectively operable to cut an annular top portion of the vertical form system to grade.

10. The invention according to claim 9, wherein either the first or second disks abut against the inner face of the vertical form system.

11. The invention according to claim 9, wherein the alignment assembly rests upon the first disk member.

12. The invention according to claim 9, further comprising a side face member disposed between the first and second face members, wherein either the first or side face members include a centering line disposed on a surface thereof.

13. The invention according to claim 9, further comprising a rotatable handle member operably associated with the metering pole member and the fastening system, wherein the rotatable handle member is selectively operable to deploy the fastening member when the handle member is rotated in a first direction and selectively operable to retract the fastening member when the handle member is rotated in a second direction.

14. The invention according to claim 9, further comprising a transit system releasably disposed on the first face member, wherein the transit system is selectively operable to determine a grade level for the vertical form system.

15. The invention according to claim 9, wherein the vertical form system is either aligned, leveled or plumbed when the alignment assembly is fixed relative to a first height of the vertical form system and the annular top portion of the vertical form system is cut when the alignment assembly is fixed relative to a second height of the vertical form system.

16. A method for aligning, leveling or plumbing a vertical form system for forming a structural element in situ in an earthen hole, comprising:

providing a metering pole assembly, comprising:

a metering pole member;

a first disk member disposed about the metering pole member;

a second disk member disposed about the metering pole member, wherein the first and second disk members are spaced apart, wherein the second disk member is located proximate to a first end of the metering pole member; and a selectively operable fastening system adjacent to the second disk member, wherein the fastening system is located at the first end of the metering pole member;

providing an alignment assembly, comprising:

a first face member having an area defining a first aperture formed therein; and a second face member having an area defining a second aperture formed therein;

wherein the first and second face members are held in fixed relationship with respect to one another such that the first and second apertures are substantially axially aligned;

wherein either the first or second face members includes a level system operably associated therewith;

wherein the level system is operable to determine a characteristic of the vertical form system selected from the group consisting of level, plumb, and combinations thereof;

disposing the second end of the metering pole member through the first and second apertures such that the alignment assembly rests upon the first disk member and is disposed about and releaseably mated to the metering pole assembly, wherein the alignment assembly is selectively operable to rotate about the metering pole member and travel along a length of the metering pole member;

disposing the mated metering pole member and alignment assembly within an annular inner face formed in the vertical form system;

deploying a fastening member into the inner face of the vertical form system so as to maintain the metering pole member and the alignment assembly in fixed relationship with the vertical form system;

causing the vertical form system to be aligned, leveled or plumbed; and backfilling any space between the earthen hole and an outer face of the vertical form system so as to prevent any subsequent movement of the vertical form system.

17. The invention according to claim 16, further comprising providing a cutting system rotatably disposed about the metering pole member and resting on the first face member, wherein the cutting system is selectively operable to cut an annular top portion of the vertical form system to grade.

18. The invention according to claim 17, wherein the vertical form system is either aligned, leveled or plumbed when the alignment assembly is fixed relative to a first height of the vertical form system and the annular top portion of the vertical form system is cut when the alignment assembly is fixed relative to a second height of the vertical form system.

19. The invention according to claim 16, further comprising providing a rotatable handle member operably associated with the metering pole member and the fastening system, wherein the rotatable handle member is selectively operable to deploy the fastening member when the handle member is rotated in a first direction and selectively operable to retract the fastening member when the handle member is rotated in a second direction.

20. The invention according to claim 16, further comprising providing a transit system releasably disposed on the first face member, wherein the transit system is selectively operable to determine a grade level for the vertical form system.

* * * * *